US007179180B1

(12) United States Patent
Frost

(10) Patent No.: US 7,179,180 B1
(45) Date of Patent: Feb. 20, 2007

(54) HAND ACCESSORY USABLE WITH AN IMPLEMENT HANDLE

(76) Inventor: John H. Frost, 23520 Califa St., Woodland Hills, CA (US) 91367

( * ) Notice: Subject to any disclaimer, the term of this patent is extended or adjusted under 35 U.S.C. 154(b) by 50 days.

(21) Appl. No.: 11/115,805

(22) Filed: Apr. 26, 2005

Related U.S. Application Data

(63) Continuation-in-part of application No. 10/299,351, filed on Nov. 19, 2002, now abandoned.

(51) Int. Cl.
*A63B 69/00* (2006.01)

(52) U.S. Cl. ..... 473/458; 473/206; 2/20

(58) Field of Classification Search ..... 473/451, 473/458, 206; 2/20
See application file for complete search history.

(56) References Cited

U.S. PATENT DOCUMENTS 1,200,580 A * 10/1916 Brenner ..... 2/161.3
1,690,312 A * 11/1928 Rosan ..... 473/206
2,710,190 A * 6/1955 Otto ..... 473/206
2,962,288 A * 11/1960 Lowden ..... 473/206
3,606,614 A * 9/1971 Dimitroff ..... 2/159
4,461,043 A * 7/1984 Lomedico ..... 2/21
4,836,544 A * 6/1989 Lai ..... 473/551
5,069,454 A * 12/1991 Frost ..... 473/206
5,180,165 A * 1/1993 Frost ..... 473/206
5,322,286 A * 6/1994 Frost ..... 473/568
5,588,651 A * 12/1996 Frost ..... 473/206
5,704,845 A * 1/1998 Boyte ..... 473/205
5,806,091 A * 9/1998 McHugh ..... 2/20

* cited by examiner

*Primary Examiner*—Eugene Kim
*Assistant Examiner*—M. Chambers
(74) *Attorney, Agent, or Firm*—Jack C. Munro; Sandy Lipkin

(57) ABSTRACT

A hand accessory contoured to anchor into tough areas of a hand and bridge over sensitive areas in securing a grip on an implement handle, maximizing the transmission of force to the implement handle, minimizing stress received in the upper areas and sensitive areas of the hand and increasing power transmission through the lower areas and tougher areas of the hand.

43 Claims, 12 Drawing Sheets

HAND ACCESSORY USABLE WITH AN IMPLEMENT HANDLE

REFERENCE TO PRIOR APPLICATION

This application is a continuation-in-part of U.S. patent application Ser. No. 10/299,351, filed Nov. 19, 2002 now abandoned, by the present inventor.

BACKGROUND OF THE INVENTION

1. Field of the Invention

The field of this invention relates generally to hand accessories useful for improving power transmission and improve control of the gripping and swinging movement of the hands of a human in connection with the handle of an implement, such as a baseball bat, thereby transmitting a greater amount of power and control of flight to a baseball that is struck with the baseball bat.

2. Description of the Related Art

For complete understanding of the latest embodiment 300, it would be helpful to read pages 1–8, summary pages 9–14 (previous embodiments) and detail pages 17–19 and 32–43, however, all embodiments contain components of sixth embodiment 300 and the descriptions of those embodiments may provide further understanding.

The subject matter of the present invention is an improvement over the structure defined within U.S. Pat. No. 5,180,165, issued Jan. 19, 1993, entitled HAND ACCESSORY, and U.S. Pat. No. 5,588,651, issued Dec. 31, 1996, entitled HAND ACCESSORY FOR SWINGING AN IMPLEMENT HANDLE, both invented by the present inventor, and both designed to enhance the user's gripping and/or swinging strength primarily in conjunction with a baseball bat, but also with any other round, thin handle, such as a weight lifting bar, tool, bicycle or steering wheel.

The structure of the present invention allows for a more relaxed grip on the implement handle, provides greater leverage and power, reduces stress to the hand, and also protects the hand from stinging and bruising when the implement, such as a bat, makes contact with an object, such as a ball. The effect could be described as being similar to the advantage of a vice grip over pliers.

One of the objectives of the hand accessories of the present invention is to bridge over sensitive areas (bones and tendons) within the user's hands by positioning contact points in the tough fleshy areas of the hands to 1) absorb energy and 2) support the bridges. Of great importance, the bridges connecting these contact points need to flex through the full range of hand movement during the swing, and this last requirement has been the most challenging because areas in the hand move in opposite directions to each other, and in the case of top hand grip of a bat, change directions during the gripping motion. To clarify, power from the body must flow through the hands and overcome the inertial "recoil" force of the bat against the hands during the swing, so "absorbing energy" means channeling force from the recoiling handle to not only tougher but stronger areas of the hand. (The terms, "absorbing energy or stress" from the handle and "transmission of power" from the hands are mostly interchangeable, just thought of separately depending on the objective.)

The inventor's early patents described "plugs" which were to fill certain fleshy or hollow areas of the hands in an attempt to prevent the handle from recoiling by inertia out of its proper finger grip, in other words, to support the handle. It became apparent however, that simply filling certain areas was not enough and that the structure, now more aptly described as a "bridge" or a "lever", needs to work in conjunction with certain specific movements of the hand in order to leverage (rather than block by filling) the implement handle into a more powerful position. Because the hands are not static during the swing, the hand accessory needs to be flexible, yet still hold the handle away from the bridged over sensitive areas, which has been the great difficulty in prior art devices.

It is to be understood that all the following claims of benefits includes reduction of stress to the fingers, since stress reduction to the fingers has been accomplished in all the inventor's prior patents by supporting the handle in various ways. Therefore, the following claims and objectives include reduction of stress to the fingers.

The task has been to channel stress to, and harness and direct power from, the tough, fleshy and stronger areas during the squeezing swinging motion of the implement handle. Whenever enough material was used to support the handle in its proper finger grip position, the hand accessory became "bulky" in most pro batter's description. While some high school players have used it satisfactorily in the playing of baseball, its performance previously was not up to pro standards.

Despite discomfort and an unnatural feeling, why would "too bulky" be a detriment to swinging a baseball bat? The answer was originally thought to be simply that the hand is composed of so many sensitive areas (bones and tendons), that it was nearly impossible to contact the tough areas (muscle and fleshy areas) without affecting these sensitive areas, so the hand accessory would have to be very specific with many different angles, and no matter how much smoothing or reducing of material in the sensitive areas, it was not satisfactory unless the tough, adjacent areas nearby (sometimes within one-sixteenth of an inch) were contacted to hold the structure against the force of the recoiling baseball bat handle away from the sensitive areas. It was determined from testing that any impingement of the bony/tendon areas caused a reduction in bat speed.

It was found, however, that sensitivity was not the only problem of "too bulky". If only the tough/fleshy areas were contacted (eliminating discomfort), but with too much bulk, it was again found that bat speed was lost, thus leading to the conclusion that obstruction of most areas of the hand's normal movement in gripping led to a loss of power. But the attempted solution of reducing the thickness of those areas would again allow the handle (bat) to press too hard, collapsing the material bridging the sensitive areas, which brings us back to the sensitivity problem, a circular dilemma. The objective was to find a way to obtain flexibility so that the hand could move through its full squeezing motion, yet the tough areas be contacted and connected in such a manner as to avoid stress to the sensitive areas of the hands and receive uniform stress in the tough "power areas".

The hand accessory of the present invention uses many of the same areas of contact as in the previously described patents. However, the material connecting these contact areas has changed significantly, allowing for complete hand range of motion. There has also been new structure discovered both for anchoring and for bridging over sensitive areas, to broaden both the areas of absorption of stress from the handle and areas of transmission of power by the hands. More importantly, the contact area between the handle and the exterior surface of the hand accessory has changed significantly, its position and its angle being crucial in channeling stress from the recoiling handle not only to tough areas, but stronger areas which exist in the lower areas of the hand, especially the lower tough ball and wrist.

The prior art all showed a somewhat concave exterior contacting the handle, with a convex interior filling the hand. An important change in all the embodiments of the present invention is the arcing, mostly convex exterior surface, highlighted by a "bridge" which leverages the handle away from sensitive areas of the hand.

An important recent development is a means of connecting structure in the upper area of the hand with structure in the lower area to harness power from the thumb without discomfort or stress in the thumb and upper areas of the hand.

Hand Direction:

Outside or forward is toward the fingers, upper or above towards the web, lower below or downward toward the tough ball, and inward being toward the wrist. All descriptions of the hand and hand accessory correspond to this terminology.

Grip Analysis:

For clarity, a distinction shall be made between at least three phases of the grip of the top hand during the swinging of a baseball bat, and two phases in the bottom hand. TOP HAND: In phase one, or "ready grip", the hand is relaxed with the handle located in a "finger grip" but not necessarily in the index finger, since it is primarily the little, ring, and middle fingers which generate bat speed (The little and ring finger hereinafter referred to as "lower fingers"). In phase two, the swing is initiated with the hand beginning to tighten and "tuck" under the handle led by the tough ball area. The phase three or "full squeeze" grip finds the hand reversing upwardly, and "locking" at its fullest tightened position. Phase two and three are explained more fully below.

BOTTOM HAND: There is far less movement in the bottom hand, with the handle located more in the palm than out in the fingers, the hand pivoting (closing) more below the knuckles than above the knuckles creating a rounder grip and more "hollow" palm (more space), the thumb reaching further downward, never reversing upwardly, having still greater effect of creating a more "hollow palm" than in the top hand. This motion of the bottom hand shall be called the thumb/wrist function with the thumb much further downward than the top hand. The hollow palm described above creates a loss of contact, a weakness that flared handles attempt to overcome, but the main problem is discomfort from the knob moving into the metacarpal area of the hand which can cause bruising and loss of accuracy in the swing. These problems have been overcome by the current embodiment 300.

Top hand clarification for a right hand hitter: With the handle held by the fingers outwardly against the knuckles, the inward are of the hand (including the tough ball and thumb base) pivots downward during phase two (like a door on a loose hinge hanging down angling away from the top of the door jam) the downward pivoting being allowed primarily due to flexibility in the lower knuckle joints and caused by the handle's parallel position to the ground recoiling toward the upper area of the hand, thus, the phase two "tucking" motion as the elbow of the batter draws in toward the ribs creating a slight clockwise motion of the hand with the knuckles also moving downward and toward the handle gaining more handle support and also moving into a more "cocked" position (top of hand angled back). In phase three, the hand moves to full squeeze as it uncocks and snaps forward at the wrist and within the hand itself, as the little and ring fingers tighten moving relatively toward the batter while the thumb reverses direction moving upward and outward (away from the batter) attempting to propel the handle forward, now creating a slightly counterclockwise rotation, the opposite of phase two, whereby the upper knuckles move away from the handle and the thumb moves toward the handle reducing space for the handle within the palm and creating possible bruising to the thumb second joint. During phase three, the hand ideally is flattened (as opposed to the curving hand and hollow palm of the bottom hand described above). There is little space left at this stage for any hand accessory material, and this is where the greatest stress occurs to the hand (without hand accessory) whether ball contact is made or not, as the handle is moving relatively toward the forward moving upper area of the hand, and the counterclockwise rotation drawing the second (thumb) joint nearer to the handle.

The lack of space during phase three of the top hand, created a continual dilemma until the latest discoveries were made which shall be claimed in this current invention. Another problem not completely overcome until the most recent hand accessory 300, is that while the handle in phase one is in an angle perpendicular to the ground, after the "tuck" during phase two and through phase three the hands and handle angle parallel to the ground, the lower portion of the hand traveling ahead of the upper portion of the hand, which causes the handle by inertia to force and move the hand accessory towards the upper area of the hand causing stress in that area. Testing the hand accessory by just holding the bat vertically and rocking it back and forth would often feel good, but then swinging the bat (such as in a batting cage) would cause discomfort and loss of power due to movement of the hand accessory out of its proper position even though attached to a tight fitting glove. Inertial movement of the hand accessory towards the upper area of the hand was reduced with the addition of the large, wrapping tough ball anchor found in embodiment 203. Further stabilization has now been accomplished in embodiment 300 such that the main stress receiving area is no longer in the weaker, more sensitive upper area, as current embodiment 300 channels the majority of stress to lower, tougher areas of the hand.

SUMMARY OF THE INVENTION

The most recent embodiment and primary structure of this invention for which most claims shall be made is sixth embodiment 300 of hand accessory, however a summary description of recent prior embodiments shall first be presented in chronological order (drawings also chronological) in an attempt to tie together the steps in the evolution of this product, because most of the embodiments herein stem from basic concepts expressed in earlier inventions.

First embodiment 51 of hand accessory (FIGS. 2–5) in reference to prior patents: The inventor's earliest patents sought to derive control and power from upper areas of the hand, such as filling the web in an attempt to hold the handle out in a finger grip (U.S. Pat. Nos. 5,069,454 and 5,180,165). For more reasons than will be elaborated, it was discovered that force transmission needed to be received in lower and still lower portions of the hand, reducing the amount of stress received and tension required in the hand and wrist due to bat recoil in the upper areas. For example, one type of support of the handle was sought in the inventor's prior U.S. Pat. No. 5,588,651 by filling the trough areas between finger tendons 24, 26, 54 and 56 (FIG. 1) running through the mid palm area (Reference Patent '651, FIG. 4, areas 86, 98 and 100). However, regardless how comfortable the initial grip, when the greatest stress from bat recoil is being received during the squeeze as the expanding thumb base muscle moves lower and forward, these tendons 24, 26, 54 and 56 move closer together and become "bunched up" and cannot be avoided. Also, there was not enough room for the "thumb/squeeze" because material in the palm and web areas blocked the forward/downward movement of the thumb base and though helpful in preventing bone bruises at the thumb second joint (knuckle) could cause stress to the thumb third joint at the wrist after continued usage (Reference Patent '651, FIG. 4, areas 114 and 113). Thus, the solution was to completely eliminate contact with the thumb and mid palm, and to instead bridge over the entire mid palm area by the construction of first hand accessory 51, which arcs outwardly toward the handle, rather than inwardly to fill the hand. The bridge 58 of hand accessory 51 and a separate, flexible lifeline anchor were major turning points in the development of the current embodiment.

Second embodiment 92 of hand accessory (FIGS. 6, 7 and 8): At his stage of development it was still thought that top and bottom hands required different embodiments. Just before submission of first embodiment 51 (designed for the top hand), an attempt was made to incorporate the "bridge" concept for use in the bottom hand, which led to once again attempting to contact portions of the thumb to increase leverage since contacting the thumb was now more successful, as seen in hand accessory 92, because there was no material filling the palm or upper web to block the thumb's forward/downward movement (see bottom hand movement, page 6), and also because the main area of contact was along the upper, inside area of the thumb base 31 (rather than the mid palm/lifeline/web areas) serving to push the bridge 96 further away from the sensitive mid palm creating contact in the lower area rather than direct contact with the thumb/web area. Second embodiment 92 creates a shearing force in the lower portion of thumb lever 133 (rather than a direct blocking of the handle) combined with anchoring in the hand's tough ball region 38, (between thumb base/heel anchor 114 and lower transverse crease anchor 106) which leverages the bridge 96 away from the sensitive mid palm area.

The upper area of thumb lever 133 below 130 was removed in later embodiments because it constricted forward movement of the thumb. At this point it was discovered that power derived from the thumb could be somewhat accomplished, not be direct harnessing of the thumb's movement but by allowing the outer perimeter of the thumb base 31 ("upper, inside" area) to slide forward (with no constriction) along the thumb lever 133 (FIGS. 6 and 7), the expanding thumb base muscle during the squeeze forcing the top area of the bridge 96 away from the hand, thus serving to propel the handle 48 away from the sensitive mid palm tendons, and for top hand usage, force the handle 48 into a more proper "finger grip". The concept in second embodiment 92 is one of the main claims of embodiment 203, and plays a minor role in embodiment 300, as the most current embodiments have tended towards greater anchoring in the "perimeter" of the hand, to hold the bridge 96 over the mid palm interior 28.

Third embodiment 102 in FIG. 9 is the same as second embodiment 92 in FIGS. 6, 7 and 8 with an added circular thumb attachment 152 and a strapping arrangement 154 and 160. It was found that tension applied at the proper angles in lower anchoring areas thumb base/heel anchor 114, tough ball anchor 108 and transverse crease anchor 106 would "pop" the bridge 96 further out creating greater tension such as in the strings of a tennis racquet. The circular attachment 152 was added with the possibility of it being used separately from the glove 174 (See FIG. 22), with the glove 174 being pulled over the top as is done during testing (all other embodiments being designed or expected to be built into a glove).

Fourth embodiment 182 (FIGS. 10, 11 and 12) is an attempt to apply bottom hand discoveries to a top hand embodiment, the inventor seeking for simplicity to construct a hand accessory suitable for both hands. It is quite similar to embodiments 92 and 102, however it has greater thickness in the areas of thumb base/heel anchor 170, thumb base anchor 168 and the tough ball anchor 171 (which is not apparent in the drawings) in an attempt to position the handle further out in the fingers. FIGS. 10, 11 and 12 depict an imaginary hand producing three stages of leverage derived from the bridge 165 and bridge outer edges 167 and 169, as the thumb moves forward and downward, depicted in stages 11 and 12.

The above embodiments were submitted in a patent application filed on Jun. 29, 2001, Ser. No. 09/895,101. However, further improvements in embodiments 203 and 300 of hand accessory, were being discovered, time lapsed and this application became abandoned.

Fifth embodiment of hand accessory 203 (FIGS. 13–19), overcomes some of the problems of stress and discomfort in the mid to upper areas of the top hand due to the partial shifting and collapsing of the hand accessory during phase two and three of the grip. The inventor's long-going attempt to receive stress in the lower areas of the hand finally resulted in extending the tough ball anchor 211 over a far greater area. It now rests on the fleshy heel 42 of hand 12 and extends (or "wraps") completely around the lower tough ball 39 (that is the lower portion of the hand), and from there extends outward past the little finger knuckle 41. This lower position of tough ball anchor 211 allows hand accessory 203 to position the handle somewhat outward of the little finger knuckle 41 with less stress to the little finger tendon 26, and just as important provides a lower area for bridge 226 attachment which changes the dynamics of this fifth embodiment 203. Critical to deriving benefit from this addition however, is its proper connection and interaction with the bridge 226, lifeline anchor 236 and other structure, to be described later in the "detailed description" section. With fifth embodiment 203, when the batter swings he is aware of power being generated through certain "perimeter" areas of the hand that were previously untapped sources of power, namely the lower tough ball 39, the flesh heel 42, and the upper thumb base 31 extending to the wrist 74. (Note "power being generated through" and "stress being received by" are mostly interchangeable terms.) The reasons that stress is no longer received in the mid palm 28 and other upper areas of the hand 12 is primarily because 1) the wrapping tough ball anchor 211 provides increased anchoring of hand accessory 203 preventing the handle 48 from forcing it toward the upper areas of sensitivity such as thumb joint 34, and more importantly 2) a portion of the tough ball anchor 211 below the little finger knuckle 41, which is known as the primary contact point 222 externally and the fulcrum 216 internally, provides structure to which the bridge 226 may connect which is lower in the hand 12, therefore stress from the handle 48 is received in lower areas such as lower tough ball 39, such that even though the recoiling force of handle 48 does cause some inward stretching of fifth embodiment 203 at bridge 226, any stress not carried through the tough ball anchor 211 and thumb base/wrist anchor 232 reaches only up to the hand's ring finger trough area 18 (a semi-tough area itself) rather than the upper, more sensitive areas such as the middle finger tendon 54 and thumb joint 34, and, because the bridge 226 connects to structure lower and more outward, (seen externally) more space is allowed internally for the hand's full range of motion into phase three. Another reason (a downside of 203) that there is no stress in the upper areas is because no structure is located in the upper areas (mid-palm, lifeline and web).

Sixth embodiment 300 of hand accessory (FIGS. 20–26) adds an obvious structure to previous embodiment 203, an upper area lifeline anchor 320 which "locks into" the thumb, lifeline and lower web portions of the hand, channeling force to the lower tough ball anchor 310 through a flexible junction, swivel 330, tough ball anchor 310 (by itself) being similar in concept to embodiment 203. Thus, two nearly separate structures attached only at swivel 330, whereby power generated from the lowermost area of the thumb is harnessed and transferred to the initial direct contact area of thin handle 48 being primary contact point 306 of bridge 340 both integral portions of lever 308 of tough ball anchor 310. The main stress receiving areas, which are in tough ball anchor 310 in the lower areas of the hand, have more strength and far greater flexibility than previous embodiments, primarily due to improvements in tough ball anchor 310, and additionally due to the added support of lifeline anchor 320 which allow tough ball anchor 310 to be constructed of much thinner material than embodiment 203.

Note: All mention of objectives and claims assume the understanding that this and all previous embodiments accomplished stress reduction in the fingers by support of the handle with the hand accessory, the difficulty has been to carry the force received in the hand accessory to good stress absorbing areas of the hand.

Stress received in lifeline anchor 320 is due more to motion of the thumb area than direct contact with handle 48, however there is some minimal stress received directly in the upper portions of lifeline contact 324 at lifeline/web contact 325 and possibly at glove/web anchor 326 at full recoil of handle 48 all within lifeline anchor 320, an area never previously tapped with great success because of its attachment to other structure which did not allow for the changing of angles and distances between the two areas due to forward, upward movement of the upper (thumb) area relative to the inward movement of the lower fingers (shortening of distance in the lower area) during the grip. A major accomplishment is that the hand's sensitive mid-palm and thumb areas receive little or no stress, though no structure exists between handle 48 and thumb joint 34, most stress being absorbed in the hand's lower tough ball 39 and wrist hollow 75. Also, thumb base wedge 352 presses somewhat against bridge glide 342 externally and outwardly aiding lever 308 at the base of bridge 340 in supporting handle 48 toward the fingers away from the sensitive mid-palm area.

Bridge 340 and lever 308 of tough ball anchor 310 are integrally connected to a fulcrum platform 302 which wraps around to the back side of the hand. Fulcrum platform 302 contains ridge 304 pressing upwardly at the hand's lower tough ball 39 causing a repositioning of a certain fleshy area of the hand's lower tough ball 39, the repositioned fleshy ridge 14 fitting into a fleshy relocation channel 309 at the interior of lever 308 repositioning (pressing) the hand's tough ball downwardly creating a wider hand and serving several purposes in augmenting the stress receiving ability of primary contact point 306. Primary contact point 306, the load bearing end of lever 308, is a narrow portion of bridge 340 and a thinner more resilient receptor than the primary contact point of embodiment 203 because it receives far greater surrounding support from the described structure and other structure to be explained in the detail.

Discoveries within embodiment 300 mushroomed, possibly because concepts from previous embodiments suddenly became more workable within the current two part structure so that refinements of those concepts continued the improvement of embodiment 300. For instance, there are several angles of connection of the various structure within lifeline anchor 320 and especially tough ball anchor 310 that are crucial and must be claimed. There are various thickness and shapes necessary for proper arcing away from the hand that will be claimed. For instance, the dimensions of ridge 304 and precise location of ridge/lock 303 are critical. The area of connection between the primary contact point 306 and little finger attachment 312 is also critical since this area of the hand diminishes as the hand grips, in fact the space all along lever 308 shortens meaning lever 308 must not only arc upwardly to account for the loss of hand space, but also move (flexing) forwardly (outwardly) somewhat past the lowest area of little finger knuckle 41, ridge 304 serving to not only help create repositioned fleshy ridge 14 and tough ball fleshy bank 13, but also serving as a fulcrum for lever 308 at fulcrum junction 305.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE INVENTION

Note: Because descriptions of hand areas and descriptions of the hand accessory structure are similar and may be confusing to the reader, hand descriptions will often by preceded by "the hand's . . . ", such as "the hand's lifeline 36" so as not to confuse with "lifeline anchor 88".

Figure 1:
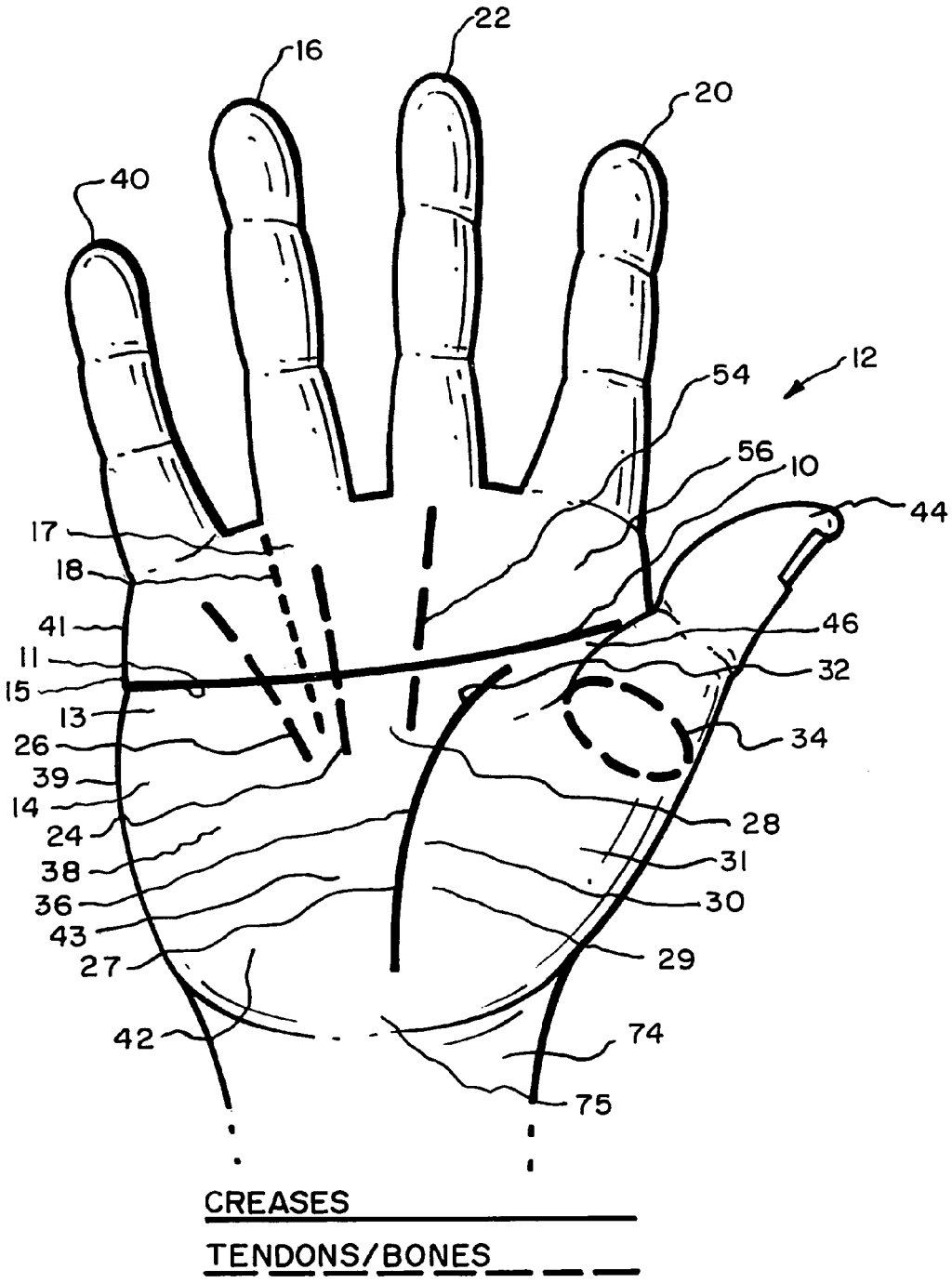
FIG. 1 is a diagrammatic depiction of a human hand depicting the different areas of the hand that the hand accessories of the present invention works in conjunction.

The material of construction of all hand accessory embodiments will normally be of semi-rigid rubber. The hand accessory may be thought of statically as a bridge and dynamically as a wedge or lever. For directional purposes, the area of each hand accessory defined as the upper, lower, outward (or forward) and inward, shall be used to apply to coinciding areas of the hand (see FIG. 1), the upper being the web 46 and including the index knuckle 56 and thumb 44, the lower area extending from the wrist hollow 75 to the little finger knuckle 41 and including the tough ball 38 lower tough ball 39 and fleshy heel 42 areas between the two. The mid palm 28 lies midway between the upper and lower areas. The outward direction (or forward) would be toward the fingers 40, 16, 22 and 20. The inward direction would be toward the wrist 74.

Outward of the mid palm 28 lie finger knuckles. Little finger knuckle 41 and ring finger knuckle 17 in combination with little finger 40 and ring finger 16 are referred to as the lower fingers. There is a transverse crease 10 within the user's hand 12. The transverse crease 10 runs from the base of the index knuckle 56 to the base of the little finger knuckle 41, the portion in the area of little finger knuckle 41 known as the lower transverse crease 11, wherein lies a ring finger trough area 18 which is a somewhat tough, concave trough. Bordering the inside and upper mid palm area 28 are the thumb base 30 and a lower web 32. The thumb base 30 is the muscular portion of the thumb below the thumb knuckle 34 and must now be distinguished from the upper thumb base 31. The thumb base 30 is bordered by the lifeline 36. Bordering the lower area of mid-palm area 28 is the tough ball 38 which is the fleshy area adjacent little finger knuckle 41. Further away from little finger tendon 26 is lower tough ball 39, which is still more tough than tough ball 38 (a better stress (reception area) and the area of primary anchor contact for fifth and sixth embodiments 203 and 300. From tough ball areas 38 and 39 the hand extends inwardly to the fleshy heel 42 which is adjacent the lower section of the lifeline 36. Lying outwardly and upwardly from fleshy heel 42 is a bony heel 43 (hamate bone) which is an exceedingly sensitive area and an obstacle to the creating of the hand accessory of the present invention since this bony heel 43 is in an area of the hand that moves a large distance during the squeezing action on an implement handle 48. Directly upward of and adjacent the bony heel is a bony lifeline which is adjacent a bony thumb base (the metacarpals). The web must be further defined than in previous patents as containing an upper web 46 between the thumb 44 and the index finger 20, and a lower web 32 extending downward to a point adjacent the thumb base 30 and the upper section of lifeline 36. It has been determined that material of any significant thickness in the upper web 46 (except pressing from the back side of the hand) is not feasible for a number of reasons, primarily because the area diminishes greatly in size during the squeeze so material in upper web 46 causes discomfort and also does not allow the implement handle 48 to contact certain areas of the hand accessory which transmit energy through the lower, stronger areas of the hand. (Filling the upper web 46, which was accomplished in the aforementioned patents, could be likened to choking up on the bat—it may provide a quicker swing, but with less power. It protects thumb bones from bruising, but adds stress to the hand.) When the hand 12 moves into phase two grip around the implement handle 48, the lower web 32 has moved lower to a position adjacent the mid palm area 28 thereby becoming somewhat of a power area. Located at the most inward area of the lifeline at the wrist is a wrist hollow, another tough, stress reception area.

The following description of hand accessory 51 is primarily for background information, contrasting earlier problems with partial solutions to the current more complete solutions found in hand accessory 300 (the embodiment to which most the claims refer) so as to provide more reasoning behind the utility of the various structures in hand accessory 300.

Figure 3:
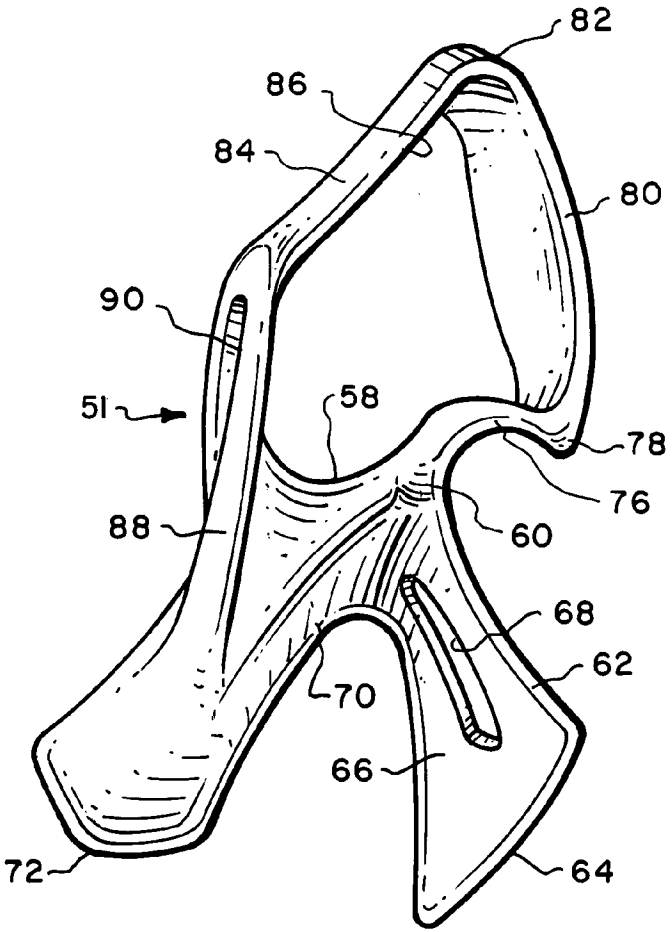
FIG. 3 is a rear elevational view of the first embodiment of hand accessory of the present invention.
Figure 2:
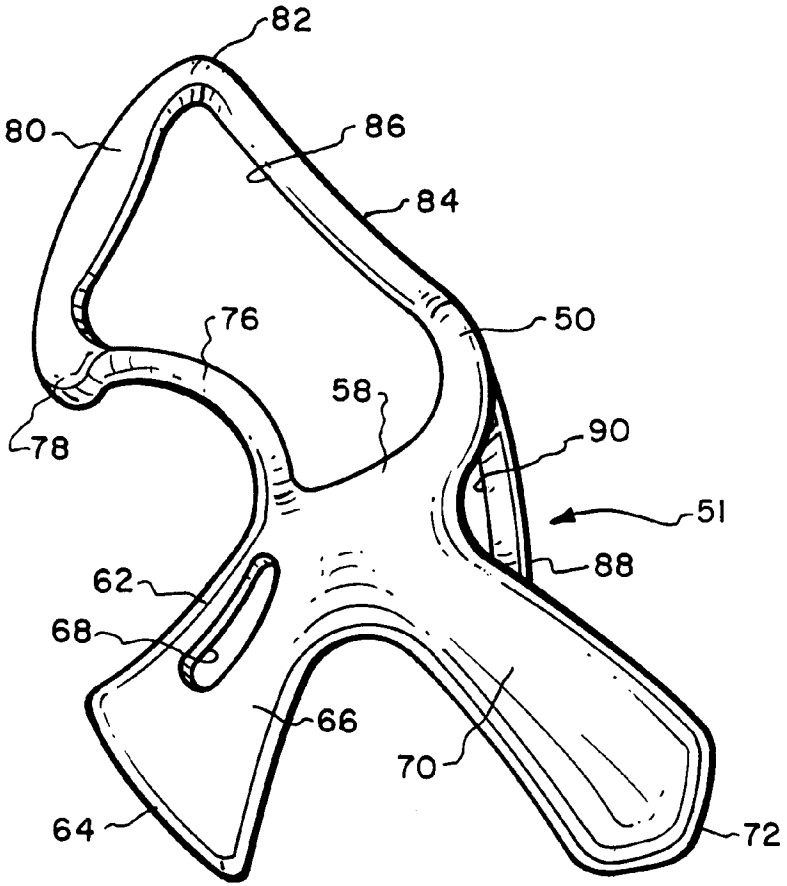
FIG. 2 is a front elevational view of the first embodiment of hand accessory of the present invention.
Figure 4:
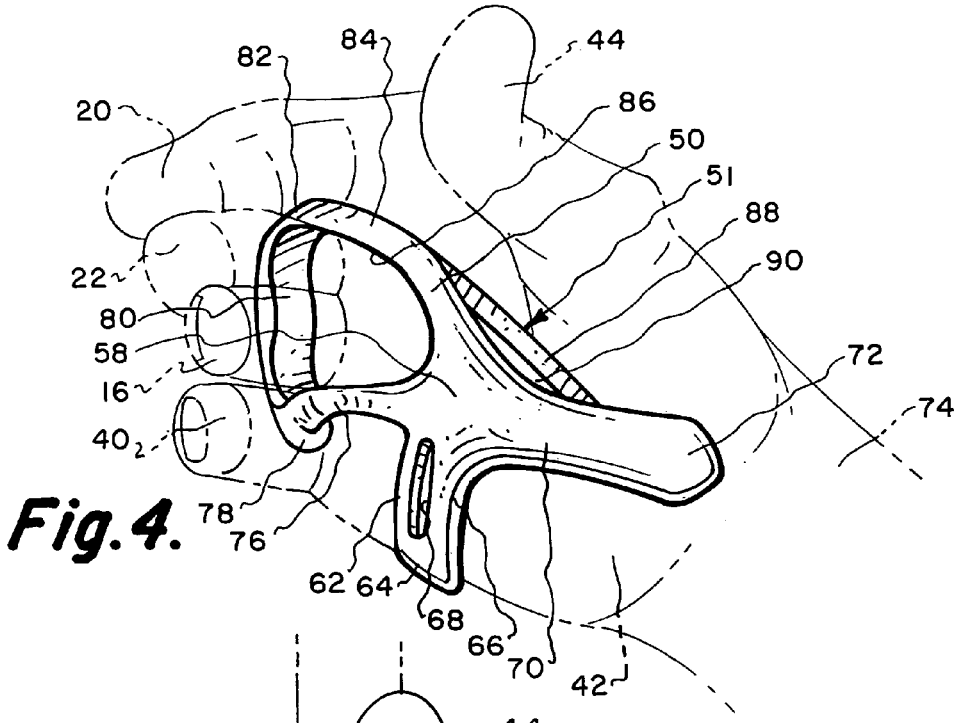
FIG. 4 is a front isometric view of the first embodiment of hand accessory of the present invention showing such mounted in an open hand.
Figure 5:
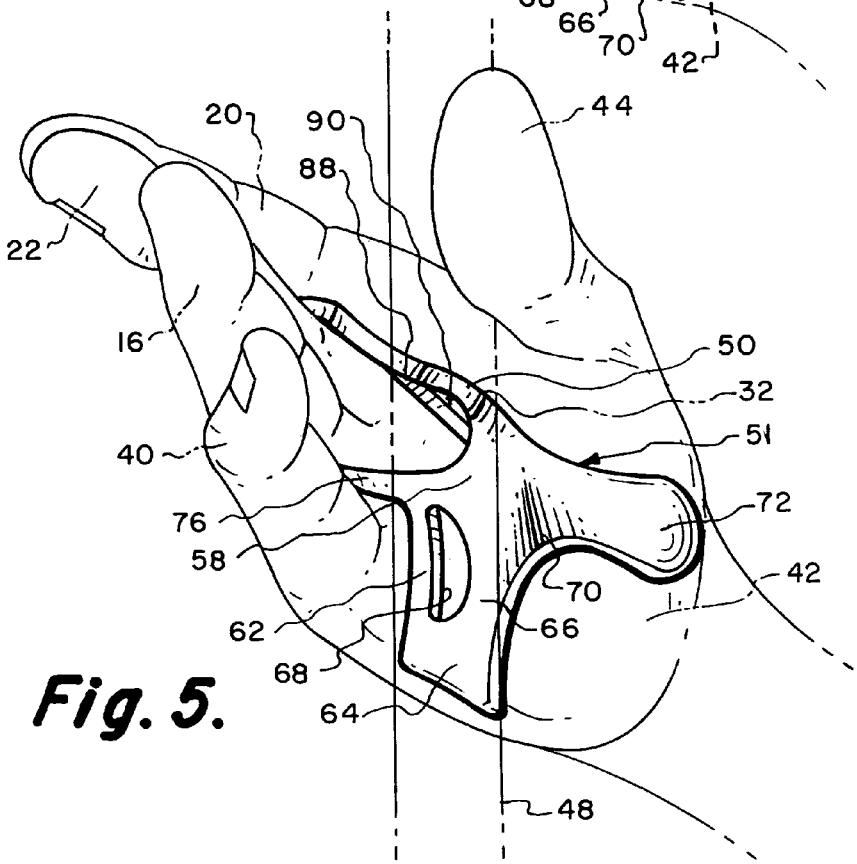
FIG. 5 is a front isometric view of the first embodiment of hand accessory of the present invention showing the first hand accessory being mounted with a human hand and depicting connection with an implement handle.

First embodiment 51 of hand accessory: FIGS. 2, 4 & 5 show the exterior surface of the first embodiment 51, parts of which would be in contact with the handle 48. FIG. 3 shows the interior surface of first embodiment 51, parts of which would be in contact with the hand 12. First embodiment 51 bridges over sensitive bony heel 43 and tendons 24, 26 and 54, and branches out in four directions to anchor in tough areas. As the hand squeezes, the bridge 58 applies force against the implement handle 48. The bridge 58 extends upwardly to connect with the flex connector 50.

Because the size of the lower web 32 diminishes during the squeezing action, the flex connector 50 of first embodiment 51 (FIGS. 2–5) which contacts the lower web 32 must be small, precise and flexible. The flex connector 50 joins three other areas all which absorb stress in bridging the sensitive mid-palm area 28. The bridge 58 extends outwardly to ring finger trough anchor 60. The bridge 58 extends downwardly along the lower transverse crease anchor 62 to tough ball anchor 64. From the tough ball anchor 64, the first embodiment 51 includes a tough ball anchor extension 66 which reconnects the bridge 58. Separating the tough ball extension 66 and the lower transverse crease anchor 62 is an opening 68. The bridge 58 extends inwardly becoming wedge 70 extending to a thumb/base heel anchor 72 which is positioned directly adjacent the wrist 74 in the lower portion of lifeline 36 which connects to the hand 12. Extending from the ring finger trough anchor 60 is a suspension 76 which is positioned directly adjacent the wrist 74 in the lower portion of lifeline 36 which connects to the hand 12. Extending from the ring finger trough anchor 60 is a suspension 76 which terminates in a nub 78. The nub 78 is to rest between the little finger 40 and the ring finger 16 on the back side of the hand. Extending from the nub 78 is a finger anchor 80 which terminates in a nub 82. The nub 82 is designed to be located between the index finger 20 and middle finger 22 on the back side of the hand. Connecting nub 82 to the flex connector 50 is a suspension 84. The suspension 84, the flex connector 50, the bridge 58, the suspension 76 and finger anchor 80 all enclose a mounting opening 86, through which the user's middle finger 22 and ring finger 16 are to be inserted. Connecting the flex connector 50 to the wedge 70 is a lifeline anchor/strut 88. The lifeline anchor/strut 88 in connection with wedge 70 and flex connector 50 enclose an opening 90. During the previously described phase two grip the suspension 84 and the lifeline anchor strut 88 move lower as one unit maintaining its position in the lifeline, as the thumb base moves lower during the squeeze. The flex connector 50 then moves upwardly and inwardly anchoring momentarily at lower web 32 under the recoiling implement handle 48.

Within the prior U.S. Pat. No. 5,588,651, the wedge 70 and the lifeline anchor strut 88 were one unit (FIG. 4, area 92). It was discovered that this caused the inside of the hand 12 to slide upwardly along the lifeline 36 during phase three grip which reduced power and added stress to the hand 12 and wrist 74, as the thumb base 30 was not able to move to its lower, more normal position. Putting it another way, the objective is to achieve what would be like the human hand 12 recreated with the thumb base 30 located further outward and downward around the area of the bony heel 43 creating a lifeline that would lie more parallel to the transverse crease 10 thus holding the implement handle 48 in the best position for power with the pivot point closer to the end of the handle 48. Lifeline anchor/strut 88 allows for an anchoring area aiding in holding bridge 58 above the sensitive mid palm area of the hand 12 while its flexibility allows the thumb 44 more movement than prior hand accessories holding the leverage power of wedge 70 in a straight line between the thumb/base/heel anchor 72 and the ring finger trough anchor 60. Lifeline anchor/strut 88 is like a brace keeping wedge 70 from collapsing as the downward force of the expanding muscle of lower thumb base 30 acting against wedge 70 is harnessed toward the handle 48. Also, lifeline anchor/strut 88, in conjunction with thumb base/heel anchor 72 and tough ball anchor 64 and tough ball anchor extension 66 position wedge 70 away from the sensitive bony heel 43.

Also, in prior U.S. Pat. Nos. 5,180,165 and 5,588,651, the lower transverse crease anchor 62 and tough ball anchors 64 and 66 were one unit. (The attempt to derive additional bat handle support from the material in the tough ball area 38 has been a challenging dilemma which was not solved until the latest sixth embodiment of hand accessory 300 (described later), however, now described first embodiment 51 was a step in the right direction so its description is included. During the squeeze the trigger action of the little finger tendon moving inwardly combined with the outward movement of the tough ball area reduces the space available for the material of the hand accessory. This results in blocking the full squeezing movement of the hand 12 and causes stress on the little finger tendon 26 just below the knuckle. Separation of the two areas by the inclusion of the opening 68 was one solution to this problem.

Figure 6:
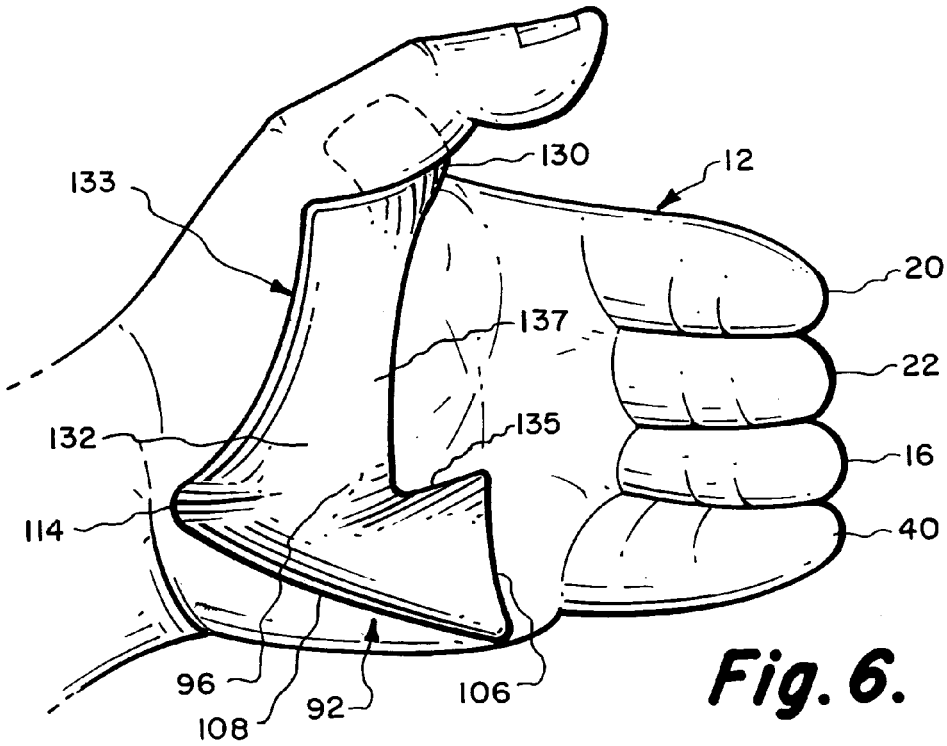
FIG. 6 is a front isometric view of a second embodiment of hand accessory of the present invention showing the second embodiment of the hand accessory being mounted within an open human hand.
Figure 7:
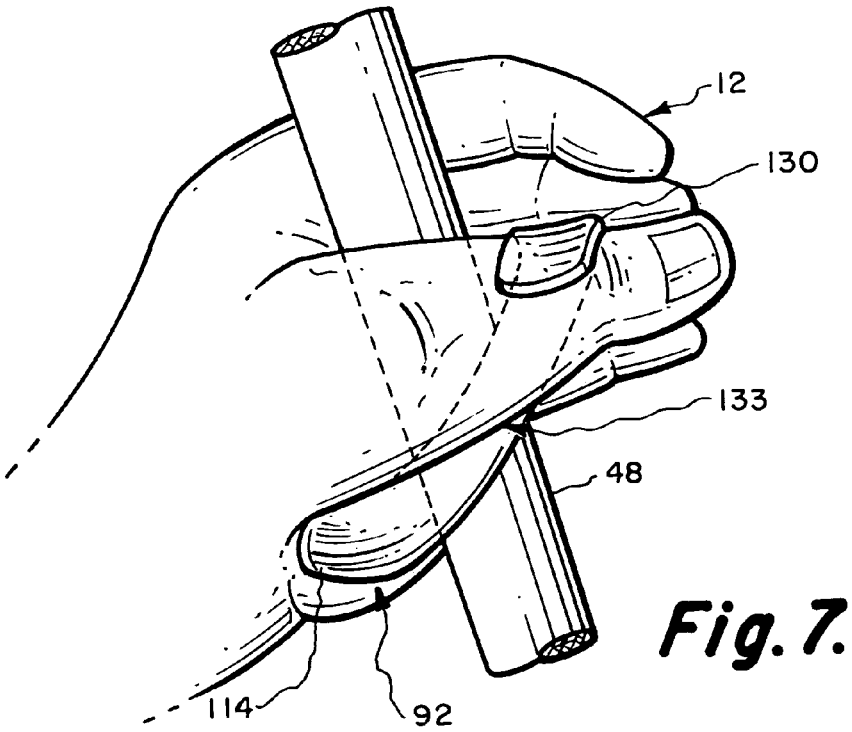
FIG. 7 is a view similar to FIG. 6 showing the second embodiment of hand accessory of the present invention in a closed hand.
Figure 8:
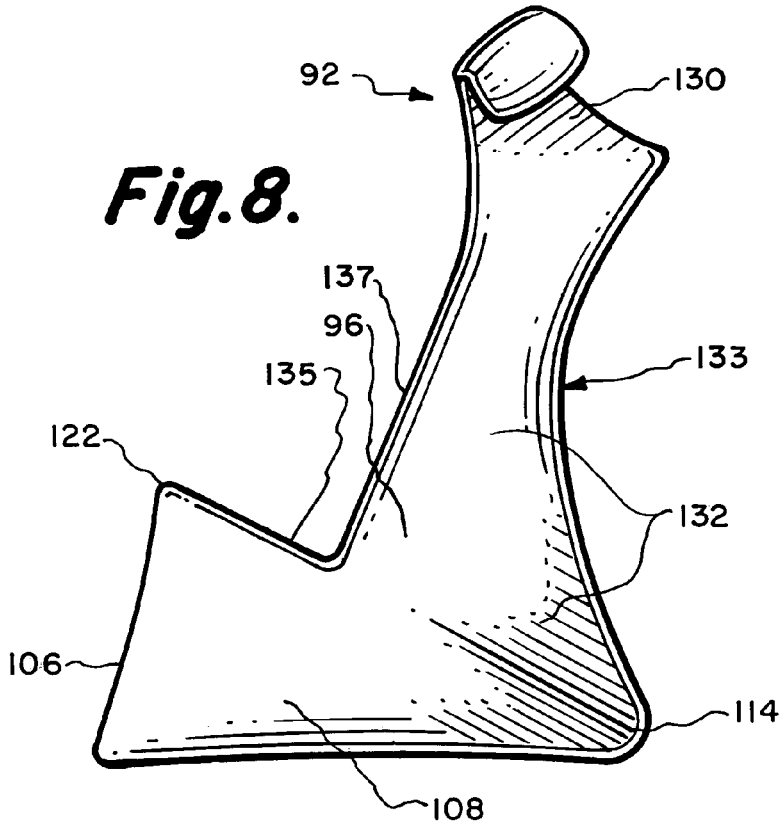
FIG. 8 is a rear elevational view of the second embodiment of hand accessory of the present invention.
Figure 9:
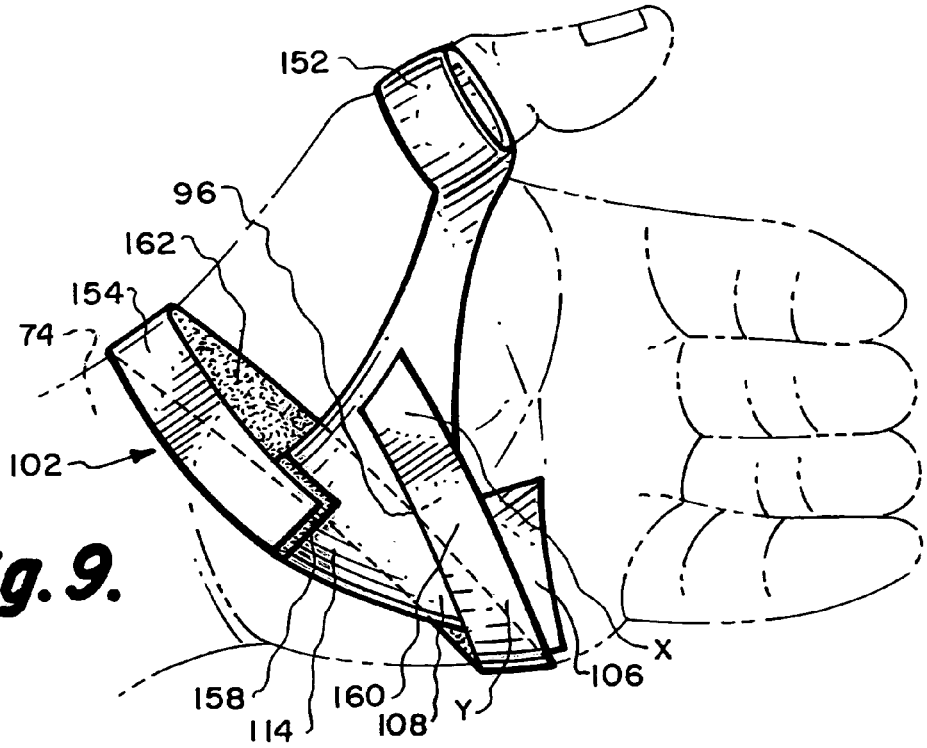
FIG. 9 is a front isometric view of a third embodiment of hand accessory of the present invention showing such mounted on an open hand.

Second embodiment 92 of hand accessory: (At this time it was still thought by inventor that different structure was needed for top and bottom hands.) Second embodiment 92 of hand accessory was designed for the bottom hand, incorporating some of the discoveries of hand accessory 51. As in hand accessory 51, hand accessory 92, see FIGS. 6, 7 and 8, has a convex exterior surface and a mostly concave interior surface, in fact, the whole body could be thought of as a bridge crossing over the sensitive mid palm 28. As in first embodiment 51, bridge 96 is also supported by a thickened thumb base/heel anchor 114, but is not constructed to arc out so far, however, it does move out considerably due to leveraging from the thumb/wrist function (bottom hand phase two described previously). The bridge 96 connects to a lower transverse crease anchor 106 and tough ball anchor 108. Bridge 96 connects inwardly to thickened thumb base/heel anchor 114 which rests only in the lower portion of lifeline 36, not extending as a wedge to the ring finger trough 18 as in first embodiment 51. Thumb base/heel anchor 114 extends upwardly to thumb base anchor 132 and thumb joint anchor 130, the whole area being called the thumb lever 133 which moves as one unit during the thumb/wrist function with the inside portion of the hand 12 and upper wrist 74 moving downward and extending outward relative to the fingers. Thumb base/heel anchor 114 aligns with the ring finger trough anchor 122, but the area between the two is thinned and concave on the interior side, both areas serving to hold the arced bridge 96 away from the sensitive mid palm area 28 and bony heel 43 of the hand 12, and also serving as a pivoting area for the downward motion of the thumb/wrist function. Thus, the thumb lever 133 with such moving sideways to the handle and partially wrapping around the handle 48 with a shearing force providing greater transmission of power in the swinging motion. (This motion better illustrated in FIGS. 10, 11 and 12.)

The third embodiment 102 of hand accessory provides a circular attachment 152 for the thumb and a strapping arrangement 154 and 160 (probably elastic) such that third embodiment 102 may be secured to the hand allowing any make of glove to be pulled over the hand rather than having third embodiment 102 attached to the inside surface of a glove (as is the intention in the other embodiments). The strapping arrangement comprises wrist strap 154 to be located about the wrist 74 of the user. Strap 154 is secured by releasable securement pad 158 to the exterior side of thumb base/heel anchor 114, then encircling the back side of the hand and wrist extending to the front side at the exterior area of bridge 96 where it is permanently secured, there called palm strap 160. The palm strap 160 is integral with the wrist strap 154. Except for the addition of the straps 154 and 160 and the circular attachment 152, the third embodiment 102 is essentially identical to embodiment 92.

It was found that the straps 154 and 160 increase the performance of third embodiment 102, probably for two reasons: Pressure on the hand's tough ball 38 and heel 42 tends to "pop out" bridge 96 increasing resistance against the handle 48, and the stretching between points x and y increases the tension between bridge 96, and tough ball anchor 108 and lower transverse crease anchor 106, (like stings of a tennis racket) increasing the force transmitted to the handle and further protecting the bony heel 43 and finger tendons 24, 26, 54 and 56. It should be noted that third embodiment 102 could have a double strapping arrangement and be built into a glove, with the separated intermediate portion 162 of the straps 154 and 160 extending to and being attachable to the outside surface (not shown) of the glove.

Figure 10:
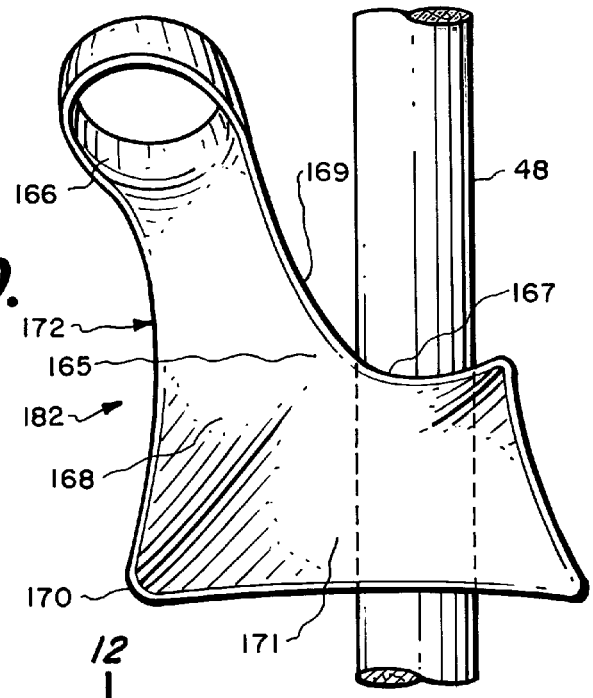
FIG. 10 is a rear isometric of a fourth embodiment of hand accessory of the present invention showing the fourth embodiment of hand accessory as it begins to connect with an implement handle.
Figure 11:
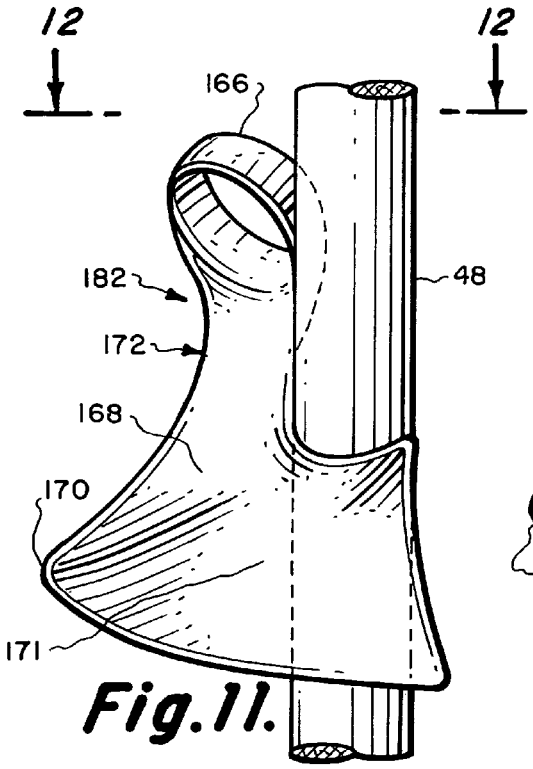
FIG. 11 is a view similar to FIG. 10 except the fourth embodiment of hand accessory is being moved in greater contact with the implement handle.
Figure 12:
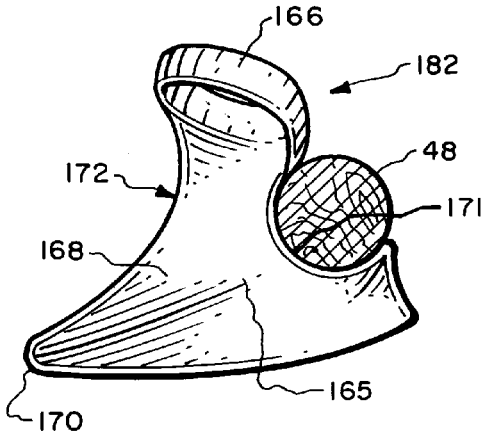
FIG. 12 is a top plan view, with the implement handle in cross-section, of the fourth embodiment of hand accessory of the present invention taken along line 12—12 of FIG. 11 as it would be with a hand at its fullest grip.
Figure 13:
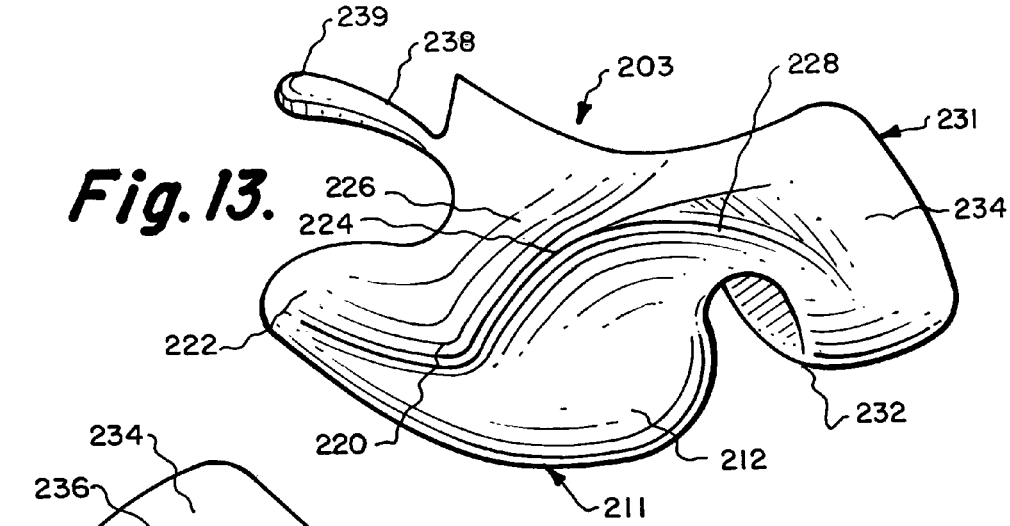
FIG. 13 is a front elevational view of a fifth embodiment of hand accessory of the present invention.

Fourth embodiment 182 is an attempt to create a top hand version of second embodiment 92 that is basically the same as the bottom hand embodiments 92 and 102 with there being differences in thickness, angles and dimensions (see FIGS. 10, 11 and 12). The following refers to the right (top) hand because it has been the main focus of the previous patents. Thus, for point of comparison and to tie together current with prior inventions, hand accessory 182 stems basically from U.S. Pat. No. 5,180,165, which was the filling of the triangular shaped palm depicted in embodiment 44, FIG. 10 (right triangle plug) of patent '165 and further, embodiment 78 depicting the harnessing of power from the thumb base connected to the right triangular shaped plug (FIG. 14) of patent '165. Thus, the concept was to allow power to flow directly from the arm and wrist through the lower portions of the hand (mid palm area 28), keeping the handle out in a finger grip and preventing stress from being received in the upper area 34 and 46 of the hand 12 from bat recoil (or any other force such as heavy bar bells). Thus, if we use outer end 68 with a small portion of base 74, eliminating the inside material (which would press against the sensitive tendons) by cutting diagonally upward to a point at top edge 70 adjacent outer end 68 (in the form of a triangle), we could then extend upward from the point at top edge 70 to our latest thumb lever 172 and extend inward from 68 to our latest thumb base anchor 168 and thickened thumb base/heel anchor 170, similar to area 84 of FIG. 14 of patent '165. In fact, the embodiment shown in FIG. 14 of patent '165 would be still more similar if area 84 arced over area 82 (instead of area 82 being concave) and if a tough ball anchor were attached at the base.

Thus, the fourth embodiment 182 (similar to the second and third embodiments, incorporates structure from first embodiment 51 such as bridge 165, tough ball anchor 171, and thumb base/heel anchor 170 (shown only internally, FIGS. 10–12), while eliminating the lifeline anchor strut 88, flex connector 50, suspension 84 (FIG. 3) and replacing such with a long thumb lever 172 which extends from thickened thumb base/heel anchor 170 to above the thumb knuckle joint 34 of hand 12 (not shown) ending at thumb anchor 166. (Thumb anchor 166 and the upper portion of thumb lever 172 were later found to be unnecessary.) Hand accessory 182 is thick only from the "base of the triangle" (patent '165, FIG. 10) and extending to the thumb base/heel anchor 170. All other areas are quite thin, but due to their configuration absorb stress all along the tough portions of the hand's tough ball 38, fleshy heel 42 and thumb base 30. Depicted in FIGS. 10, 11 and 12 is an imaginary hand moving from phase one (FIG. 10) through phase three (FIG. 12) whereby the area of the bridge outside edge 167 and thumb lever outside edge 169 known as the lever-edge 171 exerts a shearing force against handle 48.

Fifth embodiment 203 of hand accessory (FIGS. 13–19) consists of a tough ball anchor 211 and a thumb anchor 231, each of which work somewhat independently in supporting a bridge 226 which arcs over sensitive areas (description following) of hand 12.

A primary contact point 222, which is the initial direct contact and stress point between the bat handle 48 and the fifth embodiment 203 occurs in an area of the hand 12 which is lower and more outwardly (toward the fingers) than in all previous embodiments. The many benefits derived from this to be explained after first describing how this lower contact area is accomplished, starting with a tough ball anchor 211 which is much larger in area (and partially in thickness) than previous anchors in that general area.

Tough ball anchor 211 contacts the hand 12 as far inwardly as the lower portion of fleshy heel 42, extending outwardly and downwardly past the lowest portion of hand 12 (wrapping around the lower tough ball 39) to the area of the little finger bone on the back side of the hand (not shown in drawings), and continuing outwardly to the area past the little finger knuckle 41 on the back side of the hand which would be in the area of nub 78 of first embodiment 51 (FIG. 3). It arcs over (does not press against) much of the original tough ball area 38 adjacent the little finger tendon 26 (inside of hand).

Areas within tough ball anchor 211 are fulcrum 216 (seen internally), primary contact point 222 (the external side of fulcrum 216), tough ball wedge 220 (seen externally) and fleshy heel phase two lever 212. Partially within and connecting to tough ball anchor 211 are bridge 226 and lever 224 (seen externally just above tough ball wedge 220). It should be noted that a portion of tough ball anchor 211 is a bridge, most of lever 224 is a bridge, and a portion of thumb anchor 231 (described later) is a bridge, as all these areas connect in a certain gradation of thickness so as to disperse energy in the proper degree to the proper areas, however for descriptive purposes such shall be differentiated.)

Tough ball anchor 211 extends upwardly to the arcing bridge area which consists of a thinner portion, bridge 226 and a thicker portion, lever 224. Tough ball anchor 211 when combined with lever 224 becomes a tough ball wedge 220, the closest power area to fulcrum 216, which is a pivot area internally of primary contact point 222, the first area of fifth embodiment 203 to receive stress followed immediately by wedge 220 transmitting power during the phase two stage of the grip. The hand's fleshy heel 43 area of tough ball anchor 211 in combination with tough ball wedge 220 becomes a fleshy heel phase two lever 212. Lever 224, where combined further upward and inward with lifeline anchor 236 (seen only internally) becomes bridge/lifeline phase three lever 228.

Not only does the greatly enlarged tough ball anchor 211 reduce upward movement of fifth embodiment 203 as phase two grip occurs, but also harnesses the forward/downward movement of lower tough ball 39 of hand 12 to force (wedge) the handle 48 further out in the fingers and allows room for the tough ball 38 little finger tendon 26 area of hand 12 to move forward during its phase two and phase three grip, the hand 12 pivoting not so much along the transverse crease lines 10 and 11 (as it does when the handle falls out of the finger grip into the inner area of knuckles and mid palm 28), but along the area above (outwardly of) the lower knuckles 41 and 17. And, just as the longer a lever is from its fulcrum the greater the power, the further out the handle 48 is located, the greater the leverage gained from the movement of the more distant inner perimeter areas of the hand, transmitted through phase two lever 212 to tough ball wedge 220 and phase three lever 228 to contact lever 224 to bridge 226. The much large tough ball anchor 211 also makes possible the following:

In previous embodiments, a "fulcrum", or pivot point, was located in the deep area of ring finger trough 18. In fifth embodiment 203, the fulcrum 216 is actually located partially below the hand 12 in the area of lower tough ball 39, outside of the lowest portion of lower transverse crease 11, almost to the backside of hand 12 resting adjacent little finger knuckle 41 as a mostly flat, concave surface. Helping stabilize fulcrum 216 is bank 13 of hand 12, the "meaty" portion of tough ball 38 and 39 which raises up above the little finger knuckle area 41 when the hand squeezes, creating a bank 13 which one may notice by pressing one's finger inward against the lower portion of lower transverse crease 11 (while hand is gripping to close). A ridge 214 in fulcrum 216 rests against bank 13 of hand 12, further enhancing stabilization of fulcrum 216. Due to thickness at primary contact 222 and the angle and alignment with fulcrum 216 and tough ball wedge 220, as the hand 12 moves into phase two grip, primary contact point 222 next to little finger knuckle 41 is forced slightly backward by the handle 48 causing a pivoting of fifth embodiment 203 at the fulcrum 216 and bringing tough ball wedge 220 into contact with the handle, leveraging the handle 48 further toward the fingers than it would appear able to in the phase one and two grips. Except for ridge 214, fulcrum 216 is not easily distinguished visibly, rather, its presence being felt as the primary pivoting point, as all levers lead to and pivot at fulcrum 216, beginning with fleshy heel phase two lever 212, and then in concert thumb base/wedge 234, bridge/lifeline phase three lever 228 and lever 224. It is primarily this location of fulcrum 216 that allows the hand 12 to pivot (in closing) outward of the knuckles (lower knuckles 41 and 17 being the greatest challenge), and allows the handle 48 to remain outward in the lower fingers 40 and 16, creating greater leverage.

How can there be more room for the hand's forward movement as stated above? Because lever 224 arcs over and past much of the previous tough ball anchoring areas (in the inventor's earlier patents) to the lower tough ball 39 area of hand 12 creating space on the interior side of fifth embodiment 203 for the forward movement of the area of the hand's tough ball 38 and little finger tendon 26. (Note the previously described first embodiment 51 had the problem of the little and ring fingers moving inwardly while the tough ball moved outwardly (toward each other), reducing space therein for previous embodiments? That problem is now reduced because 1) there is little to no material pressing in that area (little finger tendon 26 and tough ball 38) and 2) there is now less reduction to begin with in space available for fifth embodiment 203 because the hand 12 is now pivoting relatively more outward of its lower knuckles 17 and 41 than inward (not down in the transverse crease area) since the bat is being held further out in the fingers (the hand not buckling). This also improves the phase three grip at impact keeping the lower portion of hand 12 straighter behind the handle (like a battering ram) rather than buckled.

Figure 19:
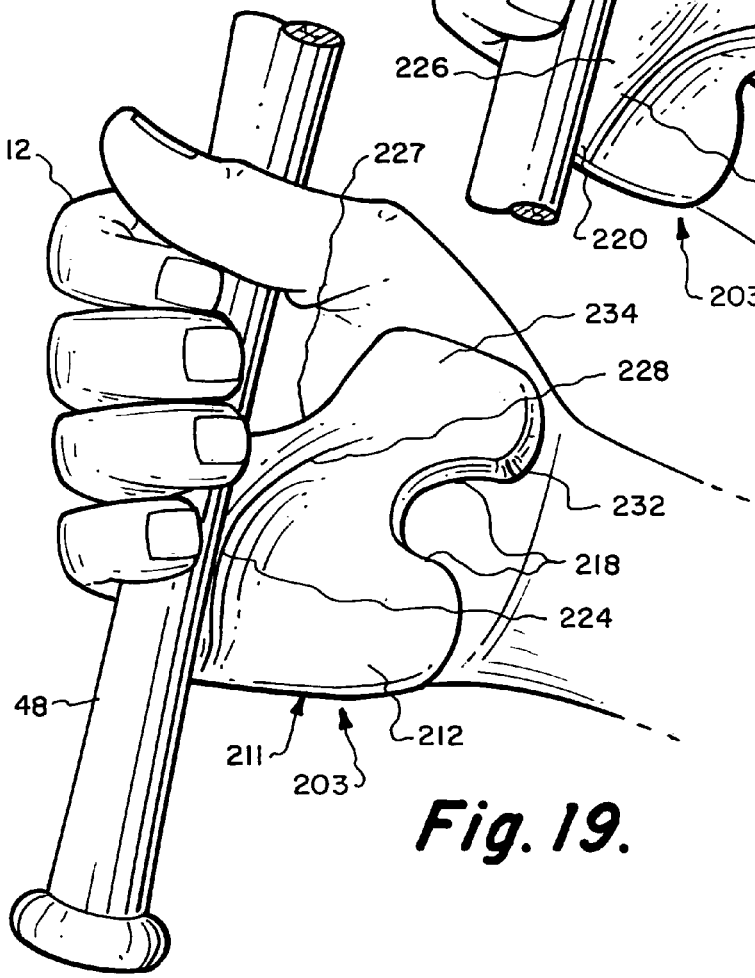
FIG. 19 is a view similar to FIG. 18 where the human hand is applying a phase three grip.
Figure 20:
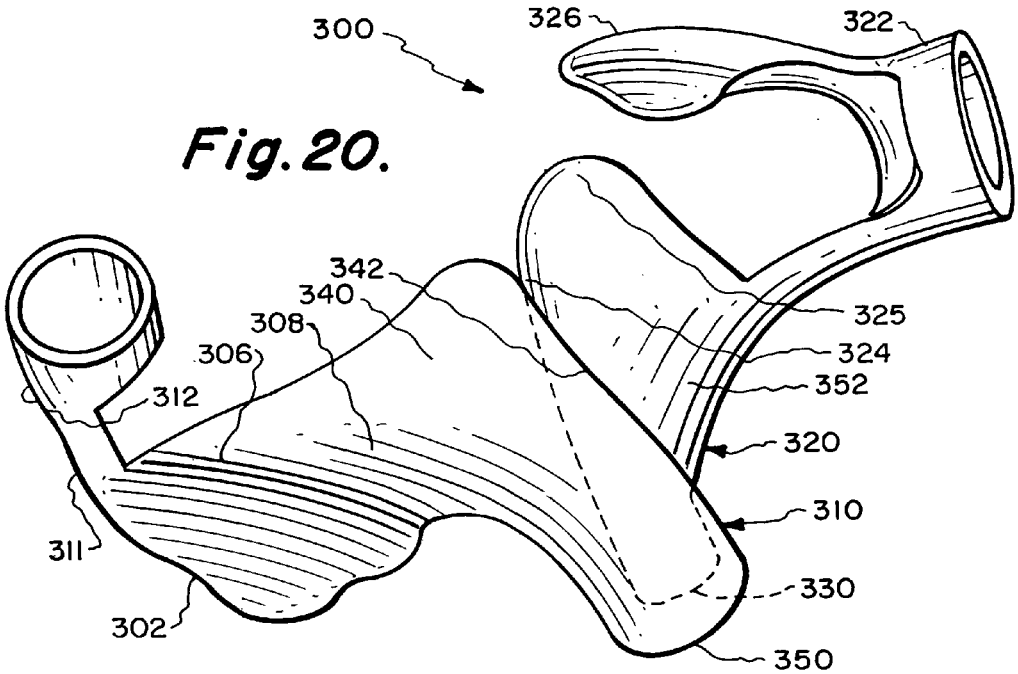
FIG. 20 is a front elevational view of a sixth embodiment of hand accessory of this invention.

As seen exteriorly (FIG. 13), phase three bridge/lifeline lever 228 extends upward and inward to thumb base/wrist anchor 232 (although its upward angle is more forward during the phase three stage of the grip as seen in FIG. 19). (The function of the thumb base/wrist anchor 232 is almost identical to the thumb base/heel anchors of the bottom hand accessories 92–192, but called thumb base/wrist anchor because fifth embodiment 203 has a separation 218 such that the anchoring area in the lower lifeline 36/thumb base 30 of hand 12 does not contact the hand's heel 42 and 43 area, rather, extends further inward to the wrist 74.)

Fleshy heel phase two lever 212 and the rest of tough ball anchor 211, in conjunction with lever 224 and lifeline anchor 236, support bridge 226 which extends outwardly from lever 224 and the bridge/lifeline phase three lever 228 becoming very thin in the area of little finger knuckle 41 and the ring finger knuckle 17. As seen interiorly (FIGS. 14 and 15), bridge 226 extends upwardly and inwardly to thickened lifeline anchor 236. Lifeline anchor 236 (seen only interiorly) extends inwardly to thumb base/wrist anchor 232 as does phase three lever 228, however, the two structures do not exactly align interiorly and exteriorly and do not travel in quite the same direction during the squeeze, the phase three lever 228 extending from the thumb base/wrist anchor 232 outwardly and downwardly (as seen exteriorly), the lifeline anchor 236 extending outwardly and upwardly (as seen interiorly). The lifeline anchor 236 aligns with the hand's lifeline 36 and ends outwardly/upwardly at the hand's lower web 32, however it does not rest in those areas and only presses slightly during phase three of the grip (during greatest stress in the upper areas), the greater pressure being felt in the area of hand 12 where lifeline anchor 236 joins thumb base/wrist anchor 232.

Seen internally, lifeline anchor 236 thins upwardly and inwardly to thinned thumb/wedge 234, which rests and is a pivot area against the hand's upper thumb base 31. Thumb base/wedge 234 does not restrict (does not attempt to harness) forward motion of the thumb during the squeeze as it did in some earlier embodiments, rather, thumb base/wedge 234 allows transmission of force from the expanding muscles in thumb bases 30 and 31 to the lifeline anchor 236, phase three lever 228, lever 224 and bridge 226, (in conjunction with thumb base/wrist anchor 232), forcing such away from the sensitive areas of mid palm 28. As seen externally, the upper portion of thumb base/wedge 234 extends lower and outward, thickening to bridge/lifeline phase three lever 228 and then contact 224. Extending further outward is the thinned area of previously described bridge 226. At an outer portion of bridge 226, located between little finger 40 and ring finger 16, a ring finger trough extension 238 extends to a finger anchor 239 on the back side of hand 12, for further support of bridge 226.

The combined area of structurally joined thumb base/wedge 234, lifeline anchor 236 and thumb base/wrist anchor 232, to be called thumb contact 231, operates somewhat independently of tough ball anchor 211. Seen better internally, a separation 218 below lifeline anchor 236 at the hand's bony heel 43 portion of tough ball anchor 211 allows for a certain independent movement of thumb contact 231. While stress is received in the thumb base/wrist anchor 232 portion of thumb contact 231 during the phase two grip (see FIG. 18), as the hand 12 moves into the phase three grip (See FIG. 19) there is a spreading of the hand 12 between the areas of tough ball 38 and thumb base 30/31 (note the larger space at separation 218 in FIG. 19). There is a recessed area (seen internally) inward of separation 218 extending from the exterior side of lifeline anchor 236 (the area of bridge/lifeline lever 228), recess 219 being thin structure extending downwardly to fleshy heel lever 212 and outwardly to the lower portion of bridge 226, recess 219 aiding separation 218 in the phase three movement. Recess 219, in combination with separation 218, fleshy heel lever 212, thumb base/wrist anchor 232 and lifeline anchor 236 helpful in providing avoidance of the hand's sensitive bony heel 43, one of the main obstacles in past embodiments.

Another factor in the improved bridging of the sensitive tendons in mid palm 28 is the angle of thumb contact 231. Rather than the lifeline anchor 236 portion arcing concavely to fit flush in lifeline 36, it is convex to lifeline 36 (See FIG. 16) flaring out such that the upper area of thumb base/wrist anchor 232 (the innermost portion of fifth embodiment 203) is an inch or more distant from hand 12 (without glove pressure). Thumb base/wrist anchor 232 also extends slightly past the hand's thumb bases 30 and 31 to anchor partially in the wrist 74 such that when glove pressure is applied at point A (FIG. 17) a pivot area 233 of thumb contact 231 pivots at the mid portions of lifeline 36 and upper thumb base 31, so that as the thumb base/wrist anchor 232 is pressed toward hand 12 by glove pressure, the other (outside) end connected to the upper area of bridge 226 pivots away from the hand, see arrow B.

Figure 18:
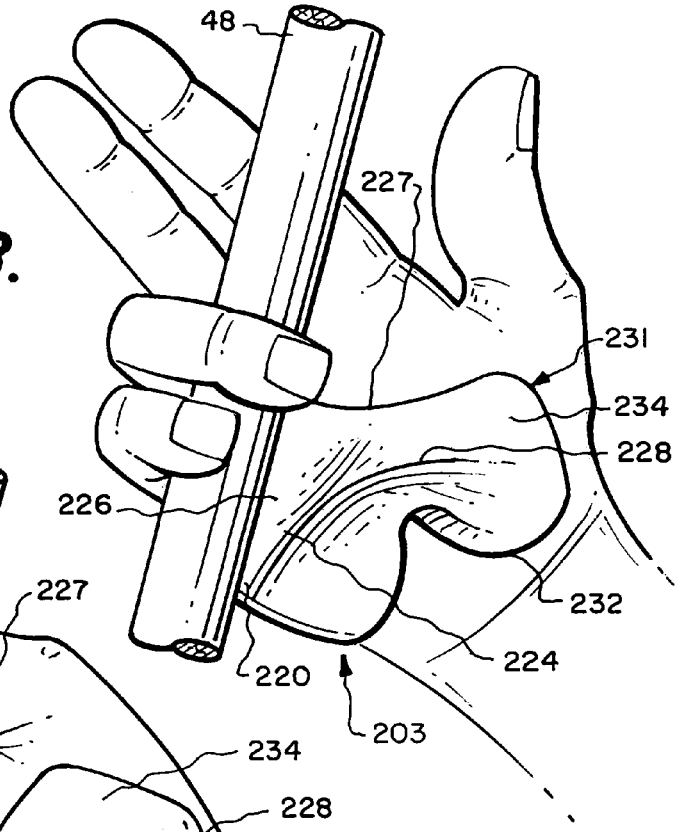
FIG. 18 is a view showing the fifth embodiment of hand accessory in conjunction with a human hand where the human hand is applying a phase two grip.

A combination of the above factors, including pivot area 233 and separation 218 cause upper bridge area 227 to arc outward, away from sensitive mid palm 28 (see FIG. 19 contrasted to FIG. 18).

Sixth embodiment 300 (FIGS. 20–26) of hand accessory consists of two nearly separate structures, a tough ball anchor 310 (with circular little finger attachment 312) and a lifeline anchor 320 (with circular thumb attachment 322), attached in only one small but precise area, swivel 330, allowing more successful thumb participation than all previous embodiments.

Figure 14:
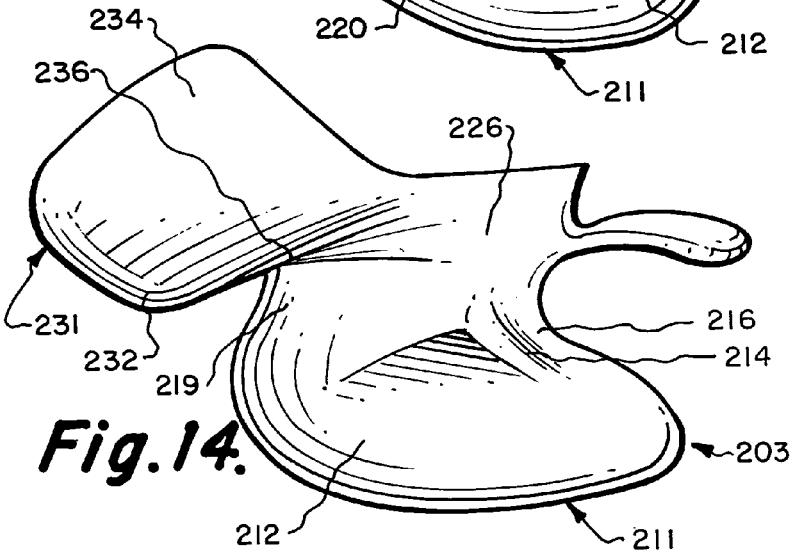
FIG. 14 is a rear elevational view of the fifth embodiment of hand accessory of the present invention.
Figure 15:
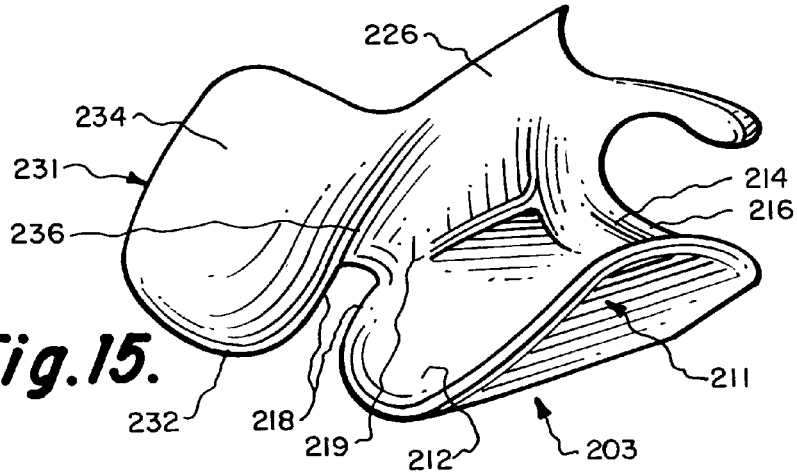
FIG. 15 is a rear elevational view of the fifth embodiment of hand accessory of the present invention taken at a slightly different angle.
Figure 16:
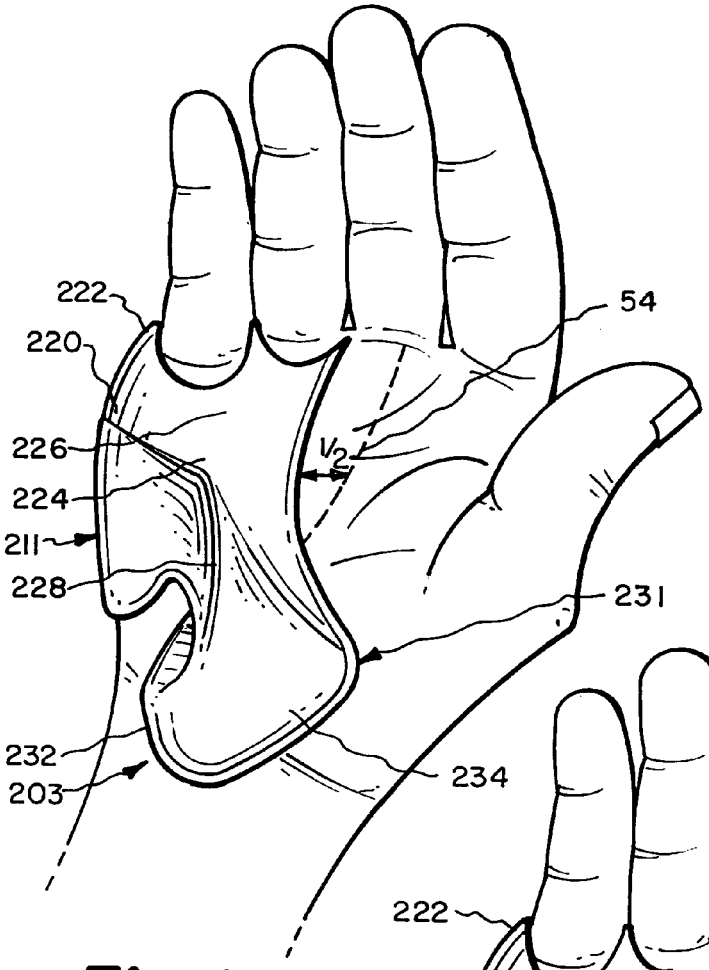
FIG. 16 is a front view of the fifth embodiment of hand accessory of the present invention showing such mounted in conjunction with a human hand and showing the fifth embodiment of hand accessory in the position it would be with no pressure being applied by an external glove.
Figure 17:
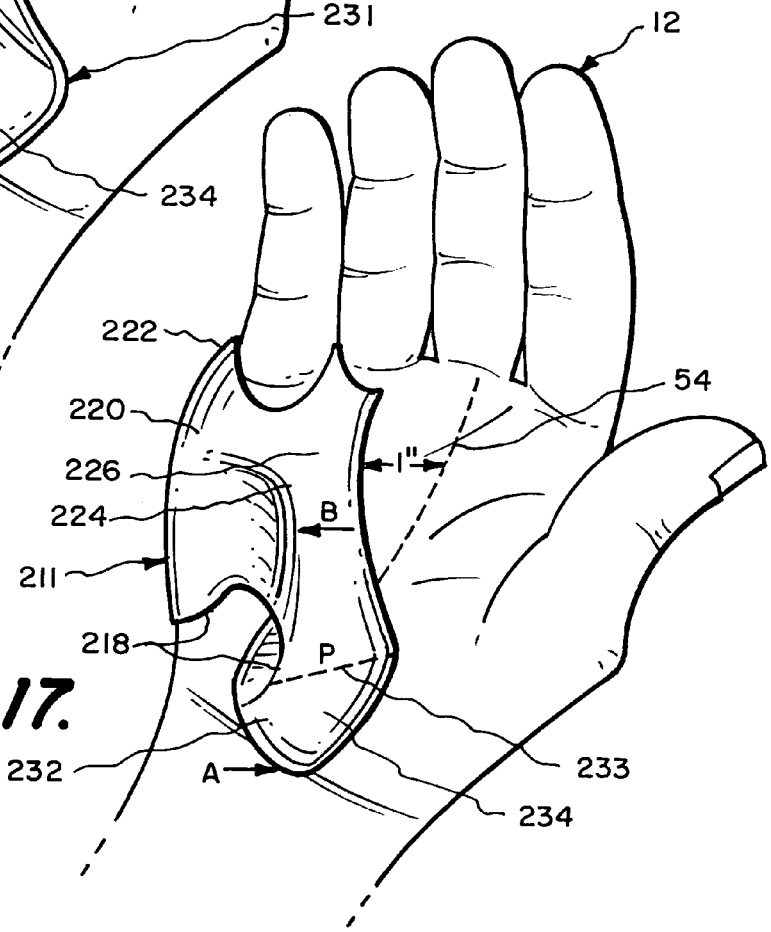
FIG. 17 is a view similar to FIG. 16 with pressure being applied to the hand accessory by an external (imaginary) glove.

The current tough ball anchor 310 is similar to and derives from the whole fifth embodiment 203, (see FIG. 14). It is important to note that tough ball anchor 310 when connected to and supported be an external glove is workable without lifeline anchor 320, however the addition of lifeline anchor 320 enhances the strength and stability of tough ball anchor 310, distributing stress over a larger area of the hand providing more complete comfort in all types of gripping of thin handles. Because areas in tough ball anchor 310 receive the majority of stress when gripping, especially when swinging a baseball bat, the importance of perfecting those areas is greater and claims on those areas will be in more detail regarding shapes, dimensions and angles.

Reiterating hand locations (FIG. 1): moving forward or outward is toward the fingers, inward being toward the wrist, upward being toward the web (upper area or "upper hand" including thumb and web), and downward being toward the tough ball (lower area or "lower hand" including tough ball, fleshy heel and wrist hollow), "lower fingers" being the little and ring fingers including the knuckle joint, and lastly, moving externally would be above (away from) the palm side or front side of the hand. All hand location numbers are two digits. All hand accessory numbers are three digits, however for added clarity hand locations are sometimes preceded by "the hand's_".

Lifeline Anchor areas: Similar in concept to "thumb anchors" of previous embodiments, the term "lifeline anchor" 320 was chosen because of the current success over past difficulties in anchoring into a certain tough area of the hand's lifeline/lower web 32 thereby harnessing power from thumb 44 without discomfort to the hand, restriction of thumb movement, or conflict with or distortion of other areas of the hand accessory, while still keeping lifeline anchoring areas fixed in their positions. Extending upwardly from its connection to tough ball anchor 310 at swivel 330 is lifeline contact 324 of lifeline anchor 320. The upper portion of lifeline contact 324 is lifeline/web contact 325 which presses into the hand's lower web 32 a very small area when the hand is in full grip but with a potential for generation of power which the current inventor has tried to tap in most previous inventions. Viewing one's gripping hand one will notice that as the bulky thumb base 30 moves forward, the index knuckle and lower web area move relatively backward (inwardly) causing a lifeline/web connection to be pushed forward out of its anchoring position. The solution was swivel 330 in conjunction with certain other structure producing a certain rotation of hand accessory 300 (explanation following) whereby thumb 44 does not slide past lifeline anchor 320 but is "locked in" by lifeline/web contact 325 held partially by pressure from handle 44 such that the thumb's motion generates power through swivel 330.

Thus, lifeline anchor 320 anchoring in the upper area of the hand harnesses power while remaining in contact with the area of the hand's lifeline 36 and lower web 32 without handle 44 causing upper area hand stress, without discomfort or impingement to the thumb's natural movement which flows downwardly, outwardly (forward) and then upwardly relative to handle 48 (see grip analysis, pages 5–7), stabilizing swivel 330 and channeling force through swivel 330 to tough ball anchor 310 anchored in the lower hand.

Much of the structure of lifeline anchor 320 is thumb base wedge 352, which contours the thumb 44 with thin material extending upwardly from swivel 330 and inwardly from lifeline contact 324, thumb base wedge 352 resting against the hand's thumb bases 30 and 31, and extending upwardly to circular thumb attachment 322, thence extending to the back side of the hand to glove/web anchor 326 pressing into the top of the hand's upper web 46 (from the back side of the hand) and serving to locate and fix the hand accessory to a glove. Glove/web anchor 326 is constructed at such an angle as to create forward tension at thumb attachment 322 away from the hand's sensitive thumb bones 34 when glove/web anchor 326 is flexed slightly forward to its attachment area of a glove. Glove/web anchor 326 also may receive contact from recoiling handle 48 depending on the user's grip, but the great majority of energy is dissipated in the lower hand through structure in the lower areas of embodiment 300.

Previous lifeline anchors often called thumb anchors had larger areas of connection to lower areas of the hand accessory such as the bridge (see previous reference to embodiment 51, FIG. 4) attempting to gain thumb strength in order to, one: thrust bridge 340 externally above sensitive knuckle and mid-palm tendons, and two: exert a holding pressure on the lower, receiving areas of the hand accessory (connected to the bridge) against internal, inward pressure or in the case of a bat handle, internal, upward and then inward pressure, however because the lower fingers move inwardly relative to the thumb moving outwardly and upwardly during the grip, various conflicts were always created. The current bridge/lifeline disconnect 343 (FIG. 23, a space where previous hand accessories were connected), formed by the proper position and angle of lifeline anchor 320 and tough ball anchor 310 joined at swivel 330 combined with improvements in tough ball anchor 310 (explained following) overcome the above problems, allowing embodiment 300 to channel force from a full range of thumb motion to lower tough ball anchor 310 where the greatest stress is received, in other words, the lifeline anchor 320 is allowed to follow thumb movement outwardly and upwardly toward the index finger 20 as tough ball anchor 310, though seen moving outwardly relative to handle 48 during phase two grip actually moves inwardly and downwardly relative to the thumb, especially during phase three grip as the thumb continues forward, the two structures becoming a further distance apart as the hand tightens through phase three. Bridge 340 is now held externally more successfully by the anchoring effect of lifeline anchor 320, channeling force from thumb movement through swivel 330 to tough ball anchor 310. Swivel 330 appears to be located at bony lifeline 27 but does not receive stress at bony lifeline 27 due to a fulcrum effect of thumb base/wrist anchor 350 holding swivel 330 comfortably away from the described sensitive areas (explained later).

[Referring back to embodiment 51 (FIG. 4): If lifeline anchor/strut 88, instead of connecting to flex connector 60 extended to and made contact only with hand 12 at web/thumb area 46 and if all structure above bridge 58 were removed, embodiment 51 would be very similar in concept to current embodiment 300 except for the lower tough ball area.]

Tough ball anchor 310: The main purpose of hand accessory 300 is to reduce stress on the weaker and/or more sensitive upper areas (upper hand) transferring stress to the lower, tough ball and wrist areas (lower hand). The main anchoring area of tough ball anchor 310 is fulcrum platform 302 resting against the hand's lower tough ball 39, its thickest area being a ridge 304 pressing into the hand's lower tough ball 39 (aided by an outer glove) creating a repositioned fleshy ridge 14 of hand 12 which fills a fleshy relocation channel 309 at the interior of tough ball anchor 310. A wider portion of ridge 304 adjacent the hand's heel 42 pressing into the lower tough ball 39 moves the repositioned fleshy ridge 14 more upwardly and exteriorly at tough ball 38 behind (inward of) the resting area of handle 48. Ridge 304 extends outwardly narrowing to a high (externally), narrow portion of ridge 304 called a fulcrum junction 305. Fulcrum junction 305 presses into a little finger knuckle recess 15, an area outward of and lower than the end point of lower transverse crease 11, against little finger knuckle 41 at the bottom of the hand, little finger knuckle recess 15 created during tightening of the grip as the portion of little finger knuckle 41 at the back side of the hand rotates outwardly (away from lower transverse cease 11) and a muscular, fleshy area rises just above lower transverse crease 11 creating bank 13 which is the most outward portion of fleshy ridge 14. Bank 13 of fleshy ridge 14 must be "locked in" or "pinched off" (blocked) at a critical area just outward of the lower transverse cease 11 which is the edge of primary contact point 306 in FIG. 21, called ridge/lock 303 seen internally arcing to meet fulcrum junction 305. Ridge/lock 303 locks in the hand's bank 13 serving to block outward movement of tough ball 38 and 39 during phase two of the grip thus blocking the relative inward movement of little finger knuckle 41 serving to maintain handle 48 in its outward finger grip, preventing inward role of handle 48 possibly giving more flight to a baseball and giving the fingers "something to pull against" (greater power in the lower fingers), fulcrum junction 305 also being the main area of fulcrum leverage for lever 308.

One may discover and understand the above by pressing one's left thumb (representing ridge 304) inward against the right hand's lower tough ball 39 in the area of transverse crease 11, while placing the left hand's index finger in the right hand outward of the knuckles as though a handle, then squeezing the handle (finger) and noticing the bank 13 rising above lower transverse crease 11 and being pinched off by pressure on the index finger which represents the bridge 340 and primary contact point 306 under the handle (finger). Notice the handle (left finger) is kept out in its finger grip, whereas removing the thumb (ridge 304) allows the hand to slide under the finger, allowing the finger (handle) to move inward.

Fulcrum platform 302 arcs slightly interiorly (upwardly) against the hand's lower tough ball 39 (most upwardly at fulcrum junction 305 of ridge 304) extending outwardly near the back side of little finger knuckle 41 and wrapping partially due to glove pressure to the back side of hand 12. Integrally attached to and rising upwardly from fulcrum platform 302 is bridge 340 ending in the mid-palm area. The area of integral attachment called lever 308 is a somewhat thickened length arcing exteriorly (away) from tough ball 38 extending inwardly from near the back side of little finger knuckle 41 at connection 311 past integrally connected primary contact point 306 (seen externally in FIGS. 20 and 25), past ridge 304 (seen internally in FIGS. 21 and 22). Lever 308 then continues past (inward of) fulcrum platform 302 reversing to an internal arc at a thickened portion of thumb base/wrist anchor 350 being a wrist fulcrum 351, the area of attachment of swivel 330. Primary contact point 306 is an integral portion of lever 308 and bridge 340, thinning outwardly at connection 311 with little finger attachment 312 and upwardly with bridge 340.

The location and composition of lever 308 is critical to the success of direct contact stress absorption. If the pathway of lever 308 towards thumb base/wrist anchor 350 moves upwardly (as in embodiment 203) angling over tough ball 38 with too much thickness, even though a tough area, discomfort from direct pressure of handle 48 will occur. The pathway of lever 308 must be as low as possible while still reaching its junction with thumb base/wrist anchor 350 (also at the lowest point allowed by stress receiving area wrist hollow 75), such that lever 308 runs primarily along the bottom of tough ball 38 (not supported by tough ball 38) but supported by fulcrum platform 302 anchored at lower tough ball 39 and "locked" into fleshy relocation channel 309, actually serving to "widen" the hand. Refinement of portions of lever 308 make hand accessory 300 workable with all types of bottom hand gripping of a baseball bat and are further explained in a final paragraph on "bottom hand gripping". A portion of the internal side of lever 308 is the hollowed fleshy relocation channel 309 which is filled by the hand's fleshy ridge 14 and bank 13, pressed lower by the angle of connection with bridge 340 held tight by ridge lock 303 where increased pressure from handle 48 occurs as recoil begins and gripping pressure tightens in phase three grip. A thickened lever portion 309 of lever 308, seen internally (FIGS. 21 and 22), extends from the area of swivel 330 above and partially defining relocations channel 309, outwardly dispersing to thinned bridge 340, lever portion 309 is also integrally connected with the thickened wrist fulcrum 351, thus combining in strength at the "lifting/prying" end of lever 308.

Lever 308 arcs externally away from the hand 12 in the area from primary contact point 306 to swivel 330, then reverses, arcing internally at wrist fulcrum 351. During the above described phase two hand movement (downwardly and forwardly toward little finger knuckle 41) the distance between the areas of hand 12 which are contacted by thumb base/wrist anchor 350 and primary contact point 306 lessens. This shortened space within the hand was the source of many problems in previous embodiments. The shortened space problems have been overcome in roughly four ways. One, because the upper area of the hand is now "locked in" to lifeline anchor 310 it no longer bumps or slides past the tough ball anchor or bridge, but channels force through swivel 330 causing lever 308 to "pop out" (flex further away from hand 12), arcing bridge 340 outwardly not only partially accounting for the reduced grip space, but serving to further increase the strength in the area of primary contact point 306 and bridge 340, increasing the amount of stress absorption of embodiment 300. Two, connection 311 between little finger attachment 312 and primary contact point 306 allows lever 308 to move slightly forward with a portion of primary contact point 306 of lever 308 moving slightly past little finger attachment 312 outward and downward of the lowest area of little finger knuckle 41 not only helping to solve the space problem but enlarging the width of the griping hand in support of the handle 48, at the proper angle to handle 48, without interfering with the thumb of the bottom hand (pressing against the top hand when holding a baseball bat) or, in the case of bottom hand usage, not interfering with the knob of handle 48. Three, swivel 330 allows tough ball anchor 310 to move inwardly relative to lifeline anchor 310 moving outwardly, and four, the "reduced grip space" itself has been lessened by fulcrum junction 305 of relocation channel 309 blocking forward movement of the lower hand at a certain point, all the above working in concert. [Note: Once permanently mounted within a glove, it is possible for connection 311 to be anchored directly to the glove without the need for little finger attachment 312.]

Figure 21:
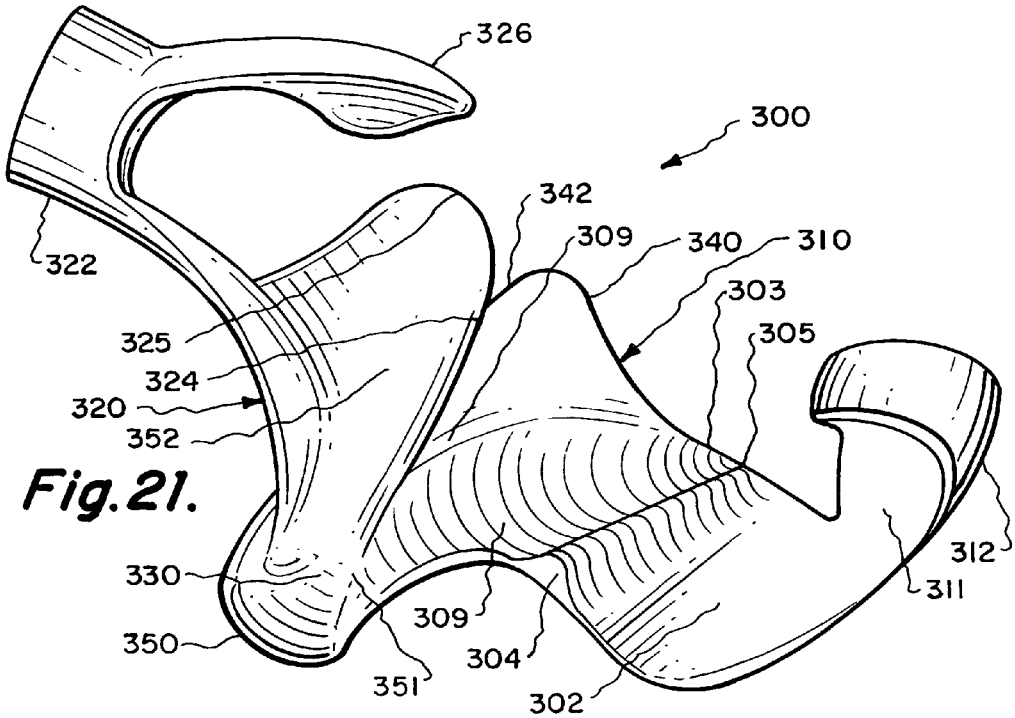
FIG. 21 is a back elevational view of the sixth embodiment of hand accessory of this invention with a fulcrum platform held open for internal viewing.
Figure 22:
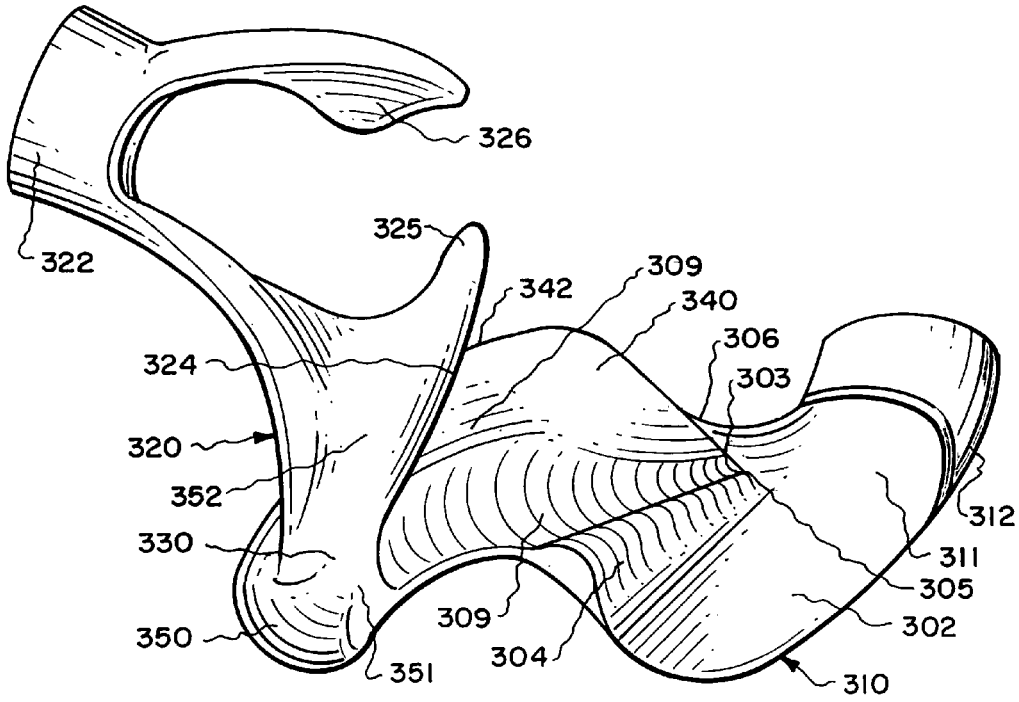
FIG. 22 is a view similar to FIG. 21 but of a modified form of hand accessory of this invention.
Figure 23:
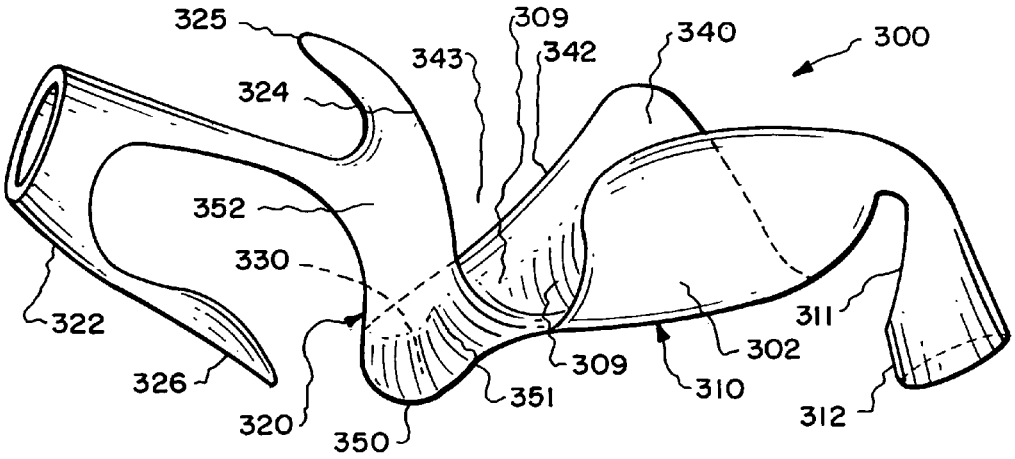
FIG. 23 is a view similar to FIG. 21 but with a modified lifeline anchor angled differently at a swivel and the fulcrum platform in its natural position (closed) when angled downward.
Figure 24:
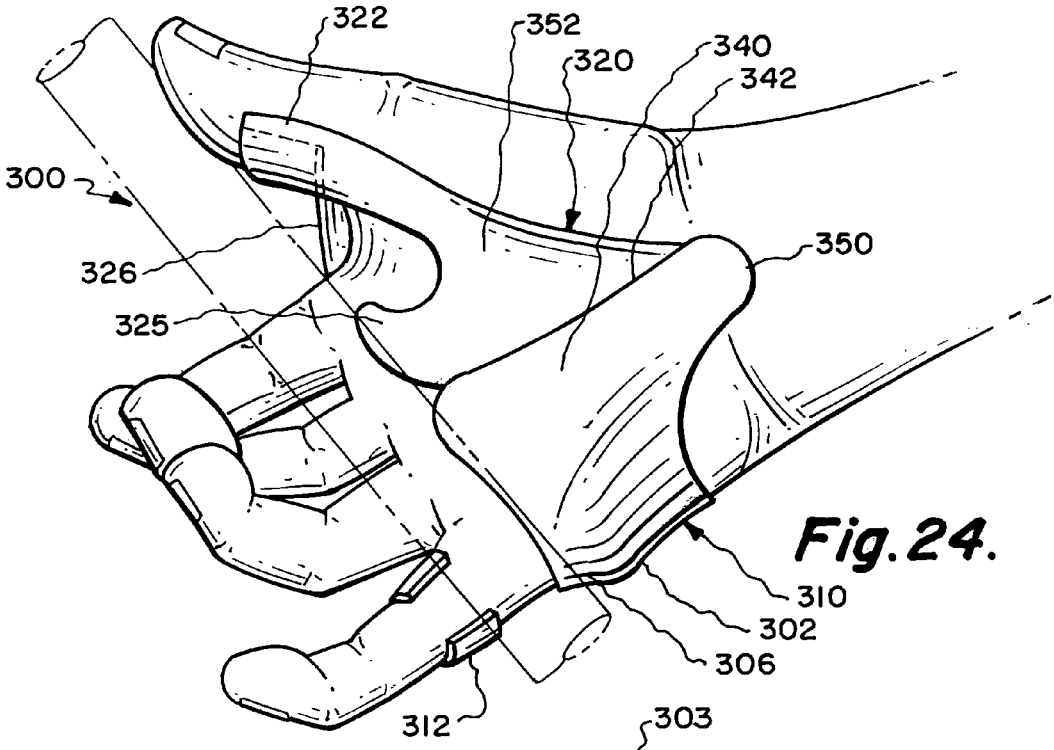
FIG. 24 is an isometric view of the sixth embodiment of hand accessory of this invention showing such mounted within an open hand.
Figure 26:
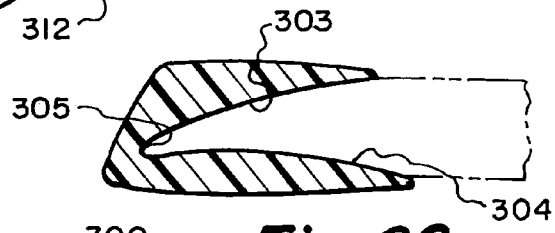
FIG. 26 is a cross-sectional view of hand accessory of this invention taken along line 26—26 of FIG. 25.
Figure 25:
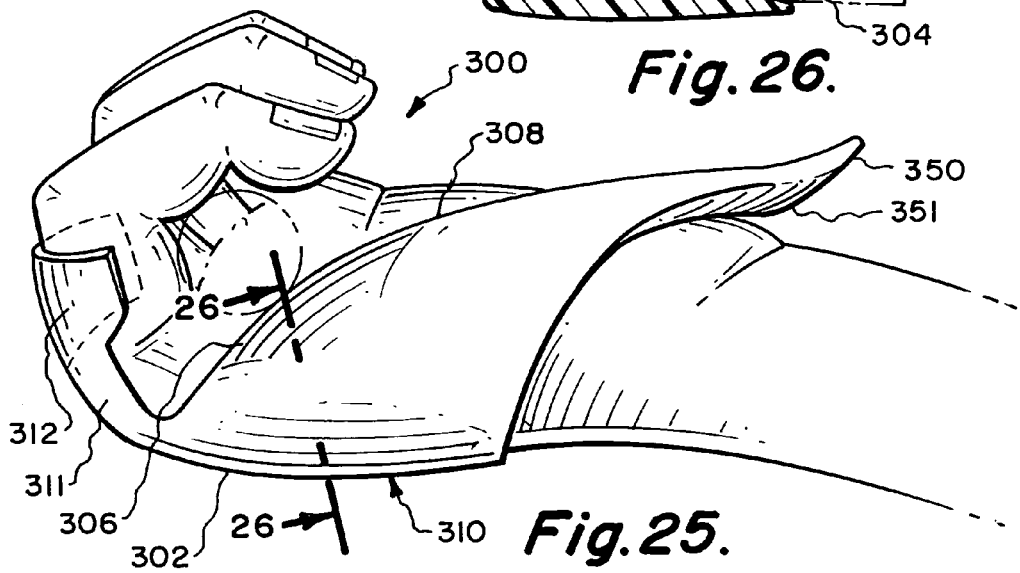
FIG. 25 is an end view of the sixth embodiment of hand accessory of this invention depicting the position of a hand closed about the implement handle.

The primary contact point 306 is the narrowest area of bridge 340 yet it is the initial contact point and thickest direct contact stress receiving area between handle 48 and sixth embodiment 300. (See previous embodiment 203 for elaboration on the concept of the primary contact point, the structure in 300 being much improved.) Primary contact point 306 is integrally connected to bridge 340, lever 308, fulcrum platform 302 and internally to ridge/lock 303. As seen in FIG. 21, ridge/lock 303 is a portion of an outer edge of primary contact point 306 arcing from bridge 340 downwardly to fulcrum junction 305 thinning becoming connection 311 connecting to little finger circular attachment 312. A modified version of connection 311 is depicted in FIG. 22 wherein the outer edge of primary contact point 306 extends from the upper area of ridge/lock 303 almost directly outward contouring the little finger knuckle 41 to little finger circular attachment 312. In this version primary contact point 306 is thicker in the area externally and outward of ridge/lock 303, providing added cushion for some types of gripping but less flexibility. Primary contact point 306 extends upward from ridge/lock 303 thinning along lower transverse crease 11 where it becomes bridge 340 pressing into the area of the hand's ring finger trough 18, bridge 340 thence extending inwardly along bridge glide 342 to and past swivel 330 becoming lever 308 ending at thumb base/wrist anchor 350. Hand accessory 300 is constructed so that thumb base/wedge 352 presses and moves against bridge glide 342 providing support, however contact in the current model is minimal occurring more with bottom hand usage as the thumb moves thumb base/wedge 352 lower to a more supporting position. Bridge glide 342 is held above the hand's sensitive mid-palm 28 less by thumb base/wedge 352 than the structure itself in the following ways. One, wrist fulcrum 351 which rotates (pries) swivel 330, lever 308 and bridge 340 away from sensitive mid-palm 28 as a result of rotational pressure from an external glove at the end of thumb base/wrist anchor 350, two, the structure within fulcrum platform 302 allows most stress reception to occur at the hand's lower tough ball 39 and wrist hollow 75 as well as locking in tough ball anchor 310 and angling handle 48 at a slight tilt away from the hand's sensitive mid-palm, and three, external and downward rotational force exerted on bridge 340 through swivel 330 from upward movement of the thumb, all the above working in concert.

The location and structure of swivel 330 is also critical. In order to gain the best leverage, swivel 330 must be located in the highly sensitive area of the metacarpals, appearing to be adjacent bony lifeline 27. Location further forward reduces leverage gained from forward movement of the thumb, further inward causes a number of problems, such as forward thumb movement causing lifeline/web contact 325 to move away from lifeline 36/web 32, and also a buckling of thumb base/wedge 352 thus discomfort to thumb base 30. Elimination of pressure from swivel 330 against bony lifeline 27 is accomplished primarily by wrist fulcrum 351, the thickened portion of thumb base/wrist anchor 330 which arcs against the hand's wrist hollow 75, a good stress absorbing area roughly one inch inward of bony lifeline 27, the arc continuing inward becoming external of wrist 74 when no glove pressure is applied such that pressure from an outer glove drawn tight at the wrist 74 presses against the thinned end of thumb base/wrist anchor 350 creating a rotation of hand accessory 300 outward of wrist fulcrum 351, lifting swivel 330, bridge 340 and lever 308 away from sensitive areas of hand 12, thus absorbing stress at the wrist while holding the handle out in the fingers. Swivel 330 has to be large enough to transfer power between tough ball anchor 310 and lifeline anchor 320, but flexible enough for the two structures to travel in different directions and prevent the bulging, forward moving thumb base 30 from displacing lifeline contact 324 from its anchoring area. Other than thinness and proper location as previously explained, the flexibility is obtained by swivel 330 actually extending to within wrist fulcrum 351 such that swivel 330, appearing to rest in the area of bony lifeline 27 is actually an extension from a wider base being part of wrist fulcrum 351 such that swivel 330 is allowed to pivot very slightly downwardly as the hand's thumb base 30 moves lower, and forwardly relative to tough ball anchor 310 preventing the thumb base 30 from moving lifeline contact 324 and lifeline/web contact 325 away from their anchoring areas in lifeline 36 and lower web 32. Thus pressure from handle 48 causes lifeline/web contact 325 to press deep within the lower web 32 of gripping hand 12 "locking in" the thumb, influencing the fingers to not pull sensitive thumb knuckle 34 toward the handle 48, giving the lower fingers 16 and 40 an anchoring area to pull against increasing power in the lower area of the hand 12 and wrist 74, as lifeline/web contact 325 is also a pivot area, stabilizing index knuckle 56 and thumb knuckle 34 away from each other, the hand 12 closing more as a pivot at the finger area, spacing thumb knuckle 34 a further distance from handle 48 than without hand accessory 300.

Bottom hand grip: Because of the above described solutions to previous thumb movement problems, current embodiment 300 is workable on both top and bottom hands in swinging a baseball bat. Several previous embodiments were fairly well received by baseball players for the top hand, but had two basic problems for use in the bottom hand. First, as described previous, in bottom hand gripping the thumb moves lower than in the top hand grip, which creates more stress on the thumb if structure is present, and the reducing distance causes buckling of the structure. Secondly, the whole tough ball area of previous hand accessory 203 (See FIG. 16, lever 224) was too thick especially in the area of tough ball 38, and it interfered with the knob end of the bat as the bat pivoted within the bottom hand. With power now being generated from upper areas of the hand at lifeline anchor 320, and more importantly anchoring improvements in tough ball anchor 310 especially ridge 304 and ridge/lock 303, a much thinner and more flexible hand accessory 300 now allows the knob of handle 48 to glide smoothly while still protecting the hand's sensitive bony heel 43 (hamate bone). Bridge 340 also accommodates direct contact with the knob of the handle if the batter chooses an overlapping grip (little finger below the knob), protecting the sensitive bony heel 43 of the hand. One last refinement was necessary to make hand accessory 300 workable with all types of gripping. The described thickened junction lever 308 in the area of lower tough ball 39 without much refinement is excellent for gripping bar bells, bicycle handle bars and top hand gripping in baseball, and can be passable for bottom hand gripping in baseball if the hand is flush with the knob (or overlapped) such that the edge of the pivoting knob slides smoothly along the lever 308. Teaching at the pro level, however, is usually to angle the bottom hand grip such that the little finger knuckle is often above the knob which causes the knob to be half on and half off lever 308 which may create a slight obstruction to the pivoting knob. Thus, a reduction of thickness especially in certain lower areas of lever 308 and a slight re-angling was necessary. The re-sloping achieved and a loss of strength compensated by the shape and angle of ridge 304 and fleshy relocation channel 309 providing a hand accessory 300 workable for all types of gripping and swinging of a baseball bat.

What is claimed is:

1. In combination with a handle of an implement when said handle is to be manually swung in motion by the hand of a human with the hand gripping and squeezing said handle, the hand composed of sensitive bony areas and tough fleshy areas, having a sensitive mid-palm which is bordered outwardly (or forward) toward the fingers by sensitive knuckles which are outward of a transverse crease extending the full width of the hand, upwardly (or above) by a lower web, inwardly by a lifeline contouring a thumb base, and downwardly or (below) by a tough ball adjacent the lower portion of the transverse crease, a lower tough ball at the lowest part of the hand and a tough, fleshy heel adjacent a wrist, thence upward and outward of the fleshy heel is a bony heel adjacent a sensitive portion of the lifeline adjacent a sensitive portion of the thumb base being a bony lifeline and bony thumb base (metacarpals), and directly inward of the bony heel at the wrist is a wrist hollow, exteriorly being away from the hand and interior being toward or pressed against the hand, the little and ring fingers and knuckles known as the lower fingers, the gripping position of the hand causing expansion of a tough ball fleshy bank at the lower transverse crease and a shortened distance between the lower fingers and the wrist hollow, the wrist hollow and areas below the mid-palm being the lower hand, the areas above being the upper hand, the lower hand being stronger and more energy absorbing than the upper hand however under utilized in the normal gripping of a thin handle, there being a pair of gripping hands defined as a top hand and a bottom hand;

a hand accessory to aid in the gripping, lifting and/or swinging of an implement handle in order to better absorb and resist the inertial force/recoil or pressure from said handle, said hand accessory receiving inertial force from said handle reducing the stress to the fingers of the gripping hand with the hand transmitting force through said hand accessory to said handle, said hand accessory designed to reduce stress received in the weaker, upper hand by utilizing areas of the stronger lower hand which without said hand accessory do not function or contribute to the gripping of thin handles;

the hand characterized by a grip moving through three discernible stages comprising a relaxed phase one grip with said handle located outward of the knuckles of the lower fingers, a phase two tuck whereby the inward area of the hand, while drawing tighter to the handle pivots outwardly but also downwardly at the knuckles (like a door on a loose hinge) relative to the fingers and said handle thus angling the upper hand a further distance from said handle (in a "cocked" position), and a phase three grip (full squeeze) whereby the hand continues outward but uncocks moving upward relative to the fingers with a thumb extending upwardly in an area of an inex finger with the thumb base as low as is allowed by the thumb position, compacting the finger tendons in the mid-palm area, a natural grip (without said hand accessory) tending to create a collapsed hand and especially in the lower hand with said lower fingers pivoting at an inner area of the knuckles during said phase three and rolling said handle inward (bat roll), the gripping hand with said hand accessory producing a flatter/longer/wider hand whereby said hand accessory allows the lower fingers to squeeze without collapsing the hand, providing a structure for the fingers to pull against, pivoting relatively more at the outward area of the knuckles with said handle remaining outward of the lower finger knuckles diminishing said bat roll, said hand accessory providing structure for the lower web of the hand to push against preventing the sensitive thumb second joint from moving as far toward said handle as without said hand accessory, yet not interfering with the normal motion of the muscular thumb base, said hand accessory further comprising:

a semi-rigid, molded body structured to flex in certain areas allowing movement in conjunction with a human hand from said phase one grip to said phase three grip designed to receive stress from the pressure of any thin handle in a bridge, said bridge being a direct contact receiving area, said bridge channeling stress through extensions to anchors resting in the tough, fleshy areas, said anchors of said hand accessory not directly in contact with said handle, said anchors pressing into three main anchoring areas, two of said three main anchors located in the lower hand and one located in the upper hand, said stress receiving bridge being supported in various degrees by said anchors such that certain areas of said bridge remain exterior of the hand and move further exteriorly during the grip and some areas of said bridge press interiorly against the hand, said bridge providing a resilient receptor (not spongy) for said handle and protecting sensitive areas of the hand and holding said handle toward the fingers to allow better control, said extensions channeling the majority of stress to the lower hand; and said three main anchoring areas describing roughly as equal sided triangle within the gripping hand, said three main anchoring areas pressing into and anchoring in the hand's lower tough ball, lower web and wrist hollow, said three main anchoring areas independent enough to stay fixed in their proper positions as the hand moves through its full range of motion from said phase one through said phase three and having a thumb attachment means.

2. The hand accessory as defined in claim 1 wherein:

said hand accessory consisting of two visibly apparent structures, a tough ball anchor and a lifeline anchor, said structures connected at a junction described as a swivel due to its thinness and flexibility, said lifeline anchor contouring the thumb, said swivel allowing transfer of power from said lifeline anchor to said tough ball anchor while allowing the thumb portion of the hand to move in a full range of motion without discomfort, said lifeline anchor containing a lifeline contact which extends from said swivel, said lifeline contact contouring the lifeline extending upwardly to a lifeline/web contact which anchors snugly in the lower web, said lifeline/web contact in said lifeline anchor being one of said three main anchoring areas, said tough ball anchor containing two of the other said three main anchoring areas, a ridge within a fulcrum platform pressing into the lower tough ball, and a thumb base/wrist anchor pressing into the wrist hollow completing said described equal sided triangle anchoring areas, said bridge being an integral portion of said tough ball anchor, a lower, leveraging portion of said bridge integrally connected to said fulcrum platform and extending inwardly to said thumb base/wrist anchor, the outer portion of said lower, leveraging portion being the initial direct contact receiving area of said handle during said phase two grip (tuck) providing improved power from the lower areas of the hand, wrist and lower fingers.

3. The hand accessory as defined in claim 2 wherein:

said lifeline anchor composed of a thumb base wedge consisting of thin material extending upwardly from said swivel contouring the thumb base, the lower, outside edge of said thumb base wedge being said lifeline contact contouring the lifeline upwardly to said lifeline/web contact anchoring in the lower web.

4. The hand accessory as defined in claim 3 wherein:

within said tough ball anchor, said lower leveraging portion of said bridge connected to said fulcrum platform being a portion of a lever, said lever being a somewhat thickened area extending inwardly from an area of the hand below the little knuckle and slightly outward of the fleshy bank on a pathway adjacent the hand's lower tough ball, tough ball and fleshy heel, ending as said thumb base/wrist anchor, said lever arcing exteriorly away from the hand's tough ball, said lever reversing its arc below said swivel arcing interiorly at said thumb base/wrist anchor creating an "s" shape as viewed from above.

5. The hand accessory as defined in claim 4 wherein:

the initial said direct contact receiving area is a primary contact point being a narrow portion of said bridge and the most outward portion of said lever, a thin, outside edge of said primary contact point extending upwardly and curving internally pressing into a fleshy ring finger hollow area in the hand's transverse crease which is the upper, outside edge of said bridge, said primary contact point seen internally arcing downwardly to an integral joining with said ridge, thence thinning to be integrally joined with said fulcrum platform wrapping toward the back side of the hand.

6. The hand accessory as defined in claim 5 wherein:

said thin area of said integral joining with said fulcrum platform extending outwardly toward the little finger at the back side of the hand, said thin area being a connection, said connection attaching directly to an external glove.

7. The hand accessory as defined in claim 5 wherein:

said connection is attached to a circular little finger attachment, said little finger attachment enclosing partially or wholly the little finger adjacent the little finger knuckle.

8. The hand accessory as defined in claim 7 wherein:

said upper, outside edge of said bridge extending inwardly as a bridge glide, said bridge glide extending to and past said swivel ending at said thumb base/wrist anchor, said bridge glide arcing in harmony with said lever externally above the sensitive mid-palm, said bridge glide being contacted and partially braced by said thumb base wedge during gripping, the lower user's thumb moves the more contact being created as in bottom hand gripping, whereby said thumb base wedge moves against said bridge glide providing additional support for said bridge especially against the knob of a baseball bat.

9. The hand accessory as defined in claim 8 wherein:

the lowest external portion of said primary contact point is located lower than the lowest point of the little finger knuckle, widening the grip of the hand, providing a resilient area for pressure from any small, thin handle, and angling said handle such that the inertial upward force of said handle does not roll said bridge internally against the sensitive mid-palm.

10. The hand accessory as defined in claim 3 wherein:

within said lifeline anchor the upper edge of said thumb base wedge extends inwardly from said lifeline/web contact, said upper edge resting against the thumb base below the sensitive thumb second joint such that no structure exists between said handle and thumb second joint, a thin strip of said thumb base wedge thence extending upwardly to connect with a circular thumb attachment.

11. The hand accessory as defined claim 10 wherein:

a thickened web/glove anchor extending from said circular thumb attachment under pressure of an external glove pressing downwardly into the uppermost area of the upper web from the back side of the hand.

12. The hand accessory as defined in claim 11 wherein:

said web/glove anchor angling from said circular thumb attachment at such an angle as to create forward tension when attached to an outer glove leveraging said circular thumb attachment and upper area of the thumb base further away from the sensitive thumb second joint and weaker upper area of the thumb base, said web/glove anchor capable of receiving some contact from said handle depending on the user's grip and the type of handle being held, the majority of stress being dissipated prior to contact with said web/glove anchor by structure in the lower hand when swinging a baseball bat, such that the shock of a poorly hit ball is not transmitted to the thumb second joint even though no hand accessory material exists at that area.

13. The hand accessory as defined in claim 3 wherein:

said swivel angling said lifeline/web contact snugly against the lower web, said lifeline/web contact being additionally held in its position by said handle such as to inhibit the thumb from sliding past said lifeline anchor such as to make the thumb an anchor for the lower fingers giving them something to pull against helping to rotate the lower area of the hand towards the handle providing greater leveraging power while the lifeline/web contact being low enough such that said handle does not block the thumb's movement, one of the factors allowing the thumb to extend fully forward and downward which is crucial in the bottom hand grip.

14. The hand accessory as defined in claim 2 wherein:
said swivel, said lifeline contact and said thumb base/wrist anchor serve to hold and propel said hand accessory away from the bony heel area preventing injury to that area.

15. The hand accessory as defined in claim 14 wherein:
the placement of said swivel providing the angle for the most beneficial pivoting of said hand accessory through phase two and three grips necessitating location just inward of at the bony lifeline area.

16. The hand accessory as defined in claim 4 wherein:
said reversing arc of said lever creating a wrist fulcrum which is the thickest portion of said thumb base/wrist anchor, said wrist fulcrum arcs against the wrist hollow holding said swivel and said lever externally from the sensitive metacarpals, said thickened wrist fulcrum also extending said hand accessory externally enough to allow said lever to exist in a lower area, bridging over a portion of the hand's heel without bending or bulging, creating a flat surface facilitating the pivoting of the knob of a baseball bat in bottom hand usage.

17. The hand accessory as defined in claim 16 wherein:
said wrist fulcrum thinning inwardly where said thumb base/wrist anchor is held tightly against the wrist by pressure from an external glove strapped tightly at the wrist, said glove pressure rotating said hand accessory externally outward of said wrist fulcrum, said wrist fulcrum intergrally connected outwardly with said lever at the junction of said swivel, the junction of said wrist fulcrum and said lever being a thickened lever portion, said junction being an upper portion of said lever (seen internally), said thickened, upper portion of said lever diminishing outwardly in said bridge, said upper, thickened portion of said lever in conjunction with said fulcrum platform partially defining a fleshy relocation channel at the interior side of said tough ball anchor.

18. The hand accessory as defined in claim 17 wherein:
said fleshy relocation channel being a hollow interior area of said lever below and partially defined by said upper, thickened lever portion, and partially defined below by said ridge of said fulcrum platform, said ridge pressing into the lower tough ball creating a repositioned fleshy ridge of the hand, said fleshy relocation channel accommodating the repositioned fleshy ridge creating greater support and stress absorption in the lower hand.

19. The hand accessory as defined in claim 18 wherein:
said area of said primary contact point seen internally arcing downwardly toward said integral joining with said ridge is a ridge/lock at the outside end of said fleshy relocation channel, said ridge/lock serving to block the forward movement of the hand's repositioned fleshy ridge at the outside area of the hand's fleshy bank, said ridge/lock preventing the hand from sliding under (outward of) said handle especially during phase two grip which keeps said handle outward in a proper finger grip providing better leverage and serving to absorb more stress in the lower hand, a source of strength which is untapped without said hand accessory.

20. The hand accessory as defined in claim 19 wherein:
said ridge/lock extending to a fulcrum junction of said ridge, said fulcrum junction being the narrowest portion of said ridge, said fulcrum junction pressing into a little finger knuckle recess of the hand just outward of and lower than the end point of the lower transverse crease, the little finger knuckle recess created during the grip as the little finger knuckle rotates to the back side of the hand away from the lower transverse crease and the fleshy bank rises up just inward of the lower transverse crease creating a valley, said ridge/lock pressing into the valley blocking the fleshy bank from moving under (outward of) said handle therefore maintaining said handle outward in the finger grip, said fulcrum junction located internally of the outermost area of said lever and said primary contact point, said fulcrum junction being a main anchoring area of said lever.

21. The hand accessory as defined in claim 20 wherein:
the phase two pivoting (hinging) at the lower transverse crease whereby the hand's tough ball moves lower than the hand's little finger knuckle which is partially blocked by said fulcrum junction preventing said handle from moving relatively higher in the hand, reducing stress received in the upper hand and reducing the stress normally felt at the tendons of the little and ring fingers, receiving greater stress at the hand's lower tough ball area, and causing the lowest area of the hand's fleshy bank to wedge said hand accessory against said hand in the phase two grip.

22. The hand accessory as defined in claim 21 wherein:
said ridge widening somewhat as it extends inwardly to a wider area of said ridge near the hand's heel, said wider area pressing the hand's fleshy tough ball upwardly by the heel just inward of said handle, said narrow area allowing the hand's tough ball fleshy bank by the lower transverse crease to be pressed downwardly by said bridge and primary contact point directly under said handle where bulkiness would otherwise cause stress to the hand, the hand's now repositioned fleshy ridge being accommodated in said fleshy relocation channel in such a configuration as to disperse stress from said handle over a greater area since the area in direct contact with said handle is now flatter and wider, with the bulkier area in a supporting position behind (inward) of said handle above said wide area of said ridge.

23. The hand accessory as defined in claim 10 wherein:
said thin strip extends from said thumb base wedge at roughly a right angle viewed vertically and also angled forward somewhat to prevent buckling of said thumb base wedge if the thumb pivots forward and downwardly at its second joint, even though that movement is not necessary in gripping.

24. The hand accessory as defined in claim 23 wherein:
when mounted within a glove, a portion of said circular thumb attachment no longer necessary is removed for greater comfort.

25. The hand accessory as defined in claim 24 wherein:
when mounted within a glove, a portion of said little finger attachment directly adjacent said handle is removed to allow the furthest possible outward (finger) grip of said handle.

26. The hand accessory as defined in claim 16 wherein:
a portion of said wrist fulcrum upward of the hand's wrist hollow contacts the lowest most inward portion of the hand's thumb base receiving additional power from that area.

27. The hand accessory as defined in claim 17 wherein:
the area said wrist fulcrum junctions with said swivel being partially separated from said thickened lever portion, said separation allowing said swivel to angle away from said thickened lever portion, said lever angle placing said lifeline anchor at roughly a right angle to said tough ball anchor, said right angle allowing more contribution of power from the hand's thumb base as well as more absorption of stress by the thumb base.

28. In combination with a handle of an implement when said handle is to be manually swung in motion by the hand of a human with the hand gripping and squeezing said handle, the hand having a sensitive mid-palm, knuckles and fingers, the sensitive mid-palm bordered outwardly directly adjacent the knuckles by a transverse crease extending the full width of the hand, upwardly by a lower web, inwardly by a lifeline contouring a thumb base, downwardly by a tough ball directly adjacent the transverse crease and lower tough ball at the lowest part of the hand, a fleshy heel directly adjacent a wrist, thence upward and outward of the fleshy heel lie the metacarpals, a sensitive area described as a bony heel, bony lifeline and bony thumb base, and inward of the bony heel at the wrist is a wrist hollow, areas below the sensitive mid-palm in particular the wrist hollow and lower tough ball being the lower hand, areas above the mid-palm in particular the thumb being the upper hand, the lower hand being the stronger area for reception of any type of impact or stress; and a hand accessory to aid in the gripping, lifting and/or swinging of an implement handle reducing stress to the fingers of the hand by supporting said handle, said hand accessory comprising a semi-rigid molded body structured to flex in certain areas and move in conjunction with a gripping hand, the exterior surface of said molded body arcing convexly at its receiving area of said handle and primarily concavely at its interior surface pressed towards the hand by said handle, said arcing receiving area being a portion of a bridge, said bridge supported by anchors spaced in surrounding tough, fleshy areas of the hand, said bridge channeling stress from said handle to said anchors and the hand transferring force from said anchors through said bridge to said handle, said hand accessory reducing the amount of stress reception within the upper hand and increasing the amount of stress reception within the lower hand, said stress reception within said lower hand occurring primarily at the hand's lower tough ball and the hand's wrist hollow, a tough ball anchor supporting said bridge pressing into the hand's lower tough ball, a thumb base/wrist anchor pressing into the hand's wrist hollow, an integral connection between said tough ball anchor and said bridge being a portion of a lever, said bridge extending upwardly arcing over the bony heel and thinning at the sensitive mid-palm, said bridge contacting and supporting said handle in various degrees with the greatest support being in the area of said lever, said lever ending inwardly at said thumb base wrist anchor pressing against the hand's wrist hollow adding support to said lever and said bridge, whereby force from the recoil or pressure of said handle is transmitted through said extensions to said anchoring areas and the shock of a poorly hit ball is absorbed and directed away from thumb second joint and having a thumb attachment means.

29. The hand accessory as defined in claim 28 wherein:

said thumb base/wrist anchor being the portion of said lever that moves the greatest distance during the gripping motion, a portion of said bridge located at the furthest outward (forward) area of said lever and furthest distance from said thumb base/wrist anchor being a primary contact point located adjacent and below the little finger knuckle joint such that inward movement of the hand's little finger knuckle is not obstructed by said bridge, said primary contact point being said hand's accessory's initial and primary direct contact with said handle, said hand accessory gaining leverage due to the distance of said thumb base/wrist anchor from said primary contact point such that during the gripping motion said primary contact point moves forward below the little finger knuckle (not blocked by the little finger knuckle) to a bracing position against said handle transmitting power to said handle, said primary contact point allowing stress to be channeled to the lower hand, reducing stress to the upper hand.

30. The hand accessory as defined in claim 29 wherein:

said tough ball anchor extending inwardly to the fleshy heel, a portion of said tough ball anchor extending to the back side of the hand surrounding the lower tough ball being a fulcrum platform, said fulcrum platform extending outward thinning to the back side of the little finger knuckle helping support the overlapping (below the knuckle) position of said primary contact point, the internal side of said fulcrum platform pressing against the hand's lower tough ball, said outward thinning portion of said fulcrum platform being a connection, said connection anchoring said hand accessory to a glove.

31. The hand accessory as defined in claim 30 wherein:

said fulcrum platform of said tough ball anchor containing a ridge, said ridge pressing into the lower tough ball adjacent and upwardly of the little finger bone (felt at the back side of the hand), said fulcrum platform arcing somewhat concavely against the lower tough ball accentuated by said ridge, said ridge pressing into the fleshy area of the lower tough ball creating a repositioned fleshy area.

32. The hand accessory as defined in claim 31 wherein:

an inner area of said ridge widening in the area of the hand adjacent the heel tending to push and reposition a fleshy area of the lower tough ball upwardly into the tough ball area inward of and in a supporting position of (behind) said handle.

33. The hand accessory as defined in claim 32 wherein:

the outer area of said ridge narrowing allowing space for the repositioning of a fleshy area of the tough ball downwardly into the lower tough ball area creating a wider area of the hand at said primary contact point and a flatter area of the hand just above said primary contact point inward and adjacent the little finger knuckle dispersing stress over a wider area.

34. The hand accessory as defined in claim 33 wherein:

the outermost area of said ridge being a fulcrum junction, said fulcrum junction pressing into a little finger knuckle recess just below the lower transverse crease.

35. The hand accessory as defined in claim 31 wherein:

the hand's repositioned fleshy area fills a fleshy relocation channel, said fleshy relocation channel being the internal side of a portion of said lever, said channel partially bordered and created by said ridge.

36. The hand accessory as defined in claim 35 wherein:

seen internally, an outer edge of said primary contact point resting in the hand's lower transverse crease and arcing to meet said fulcrum junction being a ridge lock, said ridge lock enclosing the outermost area of said fleshy relocation channel, said ridge lock blocking the hand's repositioned fleshy area from moving forward under said handle therefore keeping said handle a further distance out in the fingers relative to the tough ball area of the hand and providing the lower fingers greater leverage (something to pull against).

37. The hand accessory as defined in claim 35 wherein: said outer edge of said primary contact point extends outward of the hand's lower transverse crease contouring the little finger knuckle creating thicker cushioning at said primary contact point but sacrificing flexibility.

38. The hand accessory as defined in claim 31 wherein: said lever arcing externally from the hand in the hand's tough ball area, said lever reversing to an internal arc at the hand's wrist hollow area causing said thumb base/wrist anchor to extend roughly one inch exteriorly of the hand (wrist) without glove pressure such that pressure from an external glove applied at said thumb base/wrist anchor creates an external force on the area of said hand accessory outward of said internal arc, lifting said outward area away from and in protection of the metacarpals and sensitive mid-palm areas of the hand, more importantly moving said lever more externally and providing more tension in said lever for greater power transfer from the hand to said handle and greater stress reception in the lower hand, thus reducing stress to the metacarpals, mid-palm and upper hand.

39. The hand accessory as defined in claim 28 wherein: said integral connection between said tough ball anchor and said bridge angling said bridge at a three hundred sixty degree angle to said fulcrum platform, pressing against the interior side of said fulcrum platform when not mounted on a hand such that when mounted on a hand said bridge presses firmly against the palm of the hand tending to support and lock said hand accessory in position, the upper portion of said bridge pressing into the palm being of very thin material.

40. The hand accessory as defined in claim 28 wherein: the outside edge of said bridge resting in the hand's transverse crease extending upwardly ending at the area of the hand's lower web, thence extending downwardly being the inside edge of said bridge contouring the hand's lifeline and ending at said thumb base/wrist anchor.

41. The hand accessory as defined in claim 29 wherein: a thumb base wedge contouring a portion of the thumb base, said thumb base wedge attached to said lever, said thumb base wedge providing additional support to said lever, leveraging said bridge outward toward said handle away from the mid-palm, and supporting said lever and providing additional hand protection against a knob of a baseball bat during bottom hand gripping.

42. The hand accessory as defined in claim 41 wherein: said thumb base wedge extending upwardly toward the thumb, said thumb base wedge attaching directly to a glove.

43. In combination with a handle of an implement when said handle is to be manually swung in motion by the hand of a human with the hand gripping and squeezing said handle, the hand having a sensitive mid-palm, knuckles and fingers, the sensitive mid-palm bordered outwardly directly adjacent the knuckles by a transverse crease, upwardly by a lower web, inwardly by a lifeline contouring a thumb base, downwardly by a tough ball directly adjacent the transverse crease and a lower tough ball at the lowest part of the hand, a fleshy heel directly adjacent a wrist, thence upward and outward of the fleshy heel lie the metacarpals, a sensitive area described as a bony heel, bony lifeline and bony thumb base, and inward of the bony heel at the wrist is a wrist hollow; and a semi-rigid, molded body structured to flex in certain areas allowing movement in conjunction with a human hand designed to receive stress from the pressure of any thin handle in a bridge, a portion of said bridge receiving initial direct contact with said handle being a primary contact point, said primary contact point serving to widen the effective grip of the hand, said primary contact point extending from an area lower than the hand's lower tough ball and adjacent the little finger knuckle, contouring the little finger knuckle thence extending upwardly as said bridge extending past the mid-palm effectively to anchor in the hand's lower web but structurally separated in the area external of the mid-palm, said separation known as a disconnect space, said disconnect space allowing the thumb to move outward (forward) and upwardly while the lower fingers are moving inwardly with no conflict to either area, said anchor in the lower web is a portion of a lifeline anchor, said lifeline anchor connected to said bridge by a swivel located in the area of the hand's lower lifeline, said lifeline anchor adding support to said primary contact point against the upward and internal force of a heavy recoiling handle, said lifeline anchor also moving in said disconnect space to a bracing position interior and adjacent the upper area of said bridge providing a partial support to said bridge above the hand's sensitive mid-palm, said support rotational force to said bridge due to the angle of attachment of said swivel to said bridge as said lifeline anchor pressed internally by said handle follows the thumb's outward/upward movement in the final phase of the (full) grip and having a thumb attachment means.

* * * * *